US005582017A

United States Patent [19]

Noji et al.

[11] Patent Number: 5,582,017

[45] Date of Patent: Dec. 10, 1996

[54] CRYOPUMP

[75] Inventors: Nobuharu Noji; Junichi Hayakawa, both of Kanagawa-ken; Motoyasu Sato, Saitama-ken; Hiroshi Aono; Tetsuo Komai, both of Kanagawa-ken, all of Japan

[73] Assignee: Ebara Corporation, Tokyo, Japan

[21] Appl. No.: 427,827

[22] Filed: Apr. 26, 1995

[30] Foreign Application Priority Data

| | | | |
|---|---|---|---|
| Apr. 28, 1994 | [JP] | Japan | 6-114636 |
| Aug. 24, 1994 | [JP] | Japan | 6-224153 |
| Nov. 11, 1994 | [JP] | Japan | 6-302984 |

[51] Int. Cl.[6] ..... B01D 8/00

[52] U.S. Cl. ..... 62/55.5; 417/901

[58] Field of Search ..... 62/55.5; 417/901

[56] References Cited

U.S. PATENT DOCUMENTS

| | | | |
|---|---|---|---|
| 4,667,477 | 5/1987 | Matsuda et al. | 62/55.5 |
| 4,757,689 | 7/1988 | Bachler et al. | 62/55.5 |
| 4,918,930 | 4/1990 | Gaudet et al. | 62/55.5 |
| 4,926,648 | 5/1990 | Okumura et al. | 62/55.5 |
| 4,958,499 | 9/1990 | Haefner et al. | 62/55.5 |
| 5,231,839 | 8/1993 | de Rijke et al. | 62/55.5 |
| 5,345,787 | 9/1994 | Piltingsrud | 62/55.5 |
| 5,375,424 | 12/1994 | Bartlett et al. | 62/55.5 |
| 5,386,708 | 2/1995 | Kishorenath et al. | 62/55.5 |

FOREIGN PATENT DOCUMENTS

| | | |
|---|---|---|
| 250613 | 1/1988 | European Pat. Off. . |
| 60-171359 | 9/1985 | Japan . |
| 64-33474 | 2/1989 | Japan . |
| 1-25976 | 5/1989 | Japan . |
| 5-509144 | 12/1993 | Japan . |
| WO90/02878 | 3/1990 | WIPO . |
| WO92/08894 | 5/1992 | WIPO . |

*Primary Examiner*—Ronald C. Capossela
*Attorney, Agent, or Firm*—Wenderoth, Lind & Ponack

[57] ABSTRACT

A cryopump is provided with a detecting means for detecting an operation parameter at an elapsed operation time in a current operation cycle of the cryopump, a storing means for storing a value of another operation parameter in a past operation cycle of the cryopump as a management parameter, an arithmetic controlling means for calculating a succeeding rotational speed of the expander motor based on the current operational parameter and the management parameter stored in the storing means and outputting the same as a driving instruction signal, with which the succeeding rotational speed of the expander motor is controlled so as to maintain a temperature of a cryopanel or a pressure in a vacuum chamber to which the cryopump is attached at a predetermined value by using the operation parameter at the elapsed operation time in the current operation cycle of the cryopump detected by the detecting means and the operation parameter at the corresponding elapsed operation time in the past operation cycle of the cryopump stored in the storing means as the management parameter, and an expander motor driving means for driving the expander motor according to the driving instruction signal output from the arithmetic controlling means, whereby the cryopump may be operated stably even if a temporal load change has occurred.

18 Claims, 10 Drawing Sheets

50
53
STORING MEANS
51
ARITHMETIC CONTROL MEANS
55
CONTROL MEANS
57
EXPANDER MOTOR DRIVING MEANS
EXPANDER MOTOR
40
101
100
35
19-1
13
15
17
12
19-2
11
18
30
10
20
21

Fig. 3A
Fig. 3
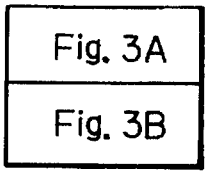
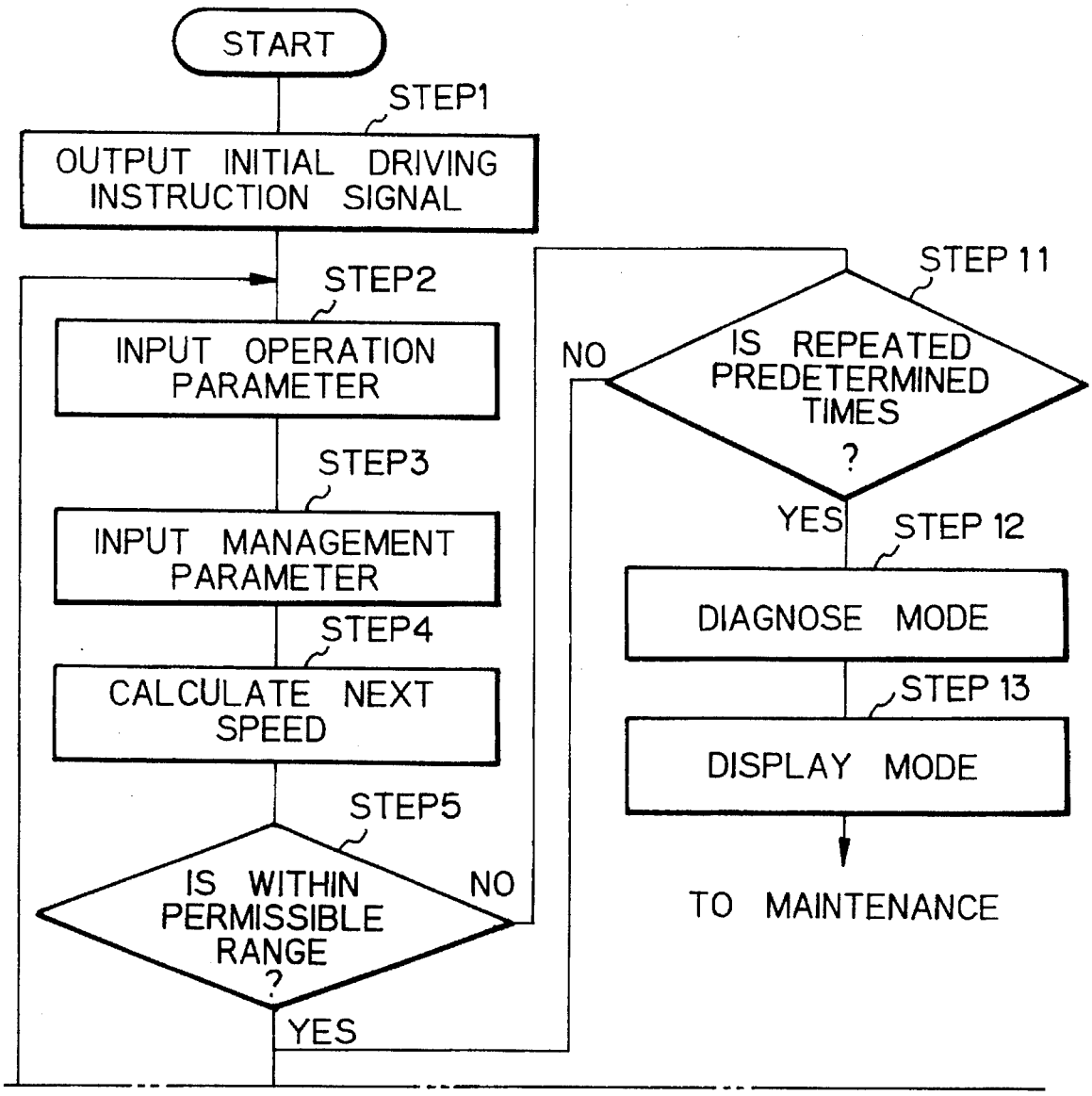

THEORETICAL CYCLE IN HELIUM REFRIGERATOR

CRYOPUMP

BACKGROUND OF THE INVENTION

1. Field of the Art

The present relates to a cryopump and control method thereof, and in particular to the same in which an optional operation conditions can be provided and the regeneration and maintenance of the cryopump can be optimized.

More particularly, the invention relates to a cryopump and control method thereof in which stable operation can be maintained even if a sudden load change occurs in the cryopump, maintenance and checking can be performed at an appropriate time, complete regeneration of the cryopump can be performed in a short period, and the temperature of a cryopanel can be controlled without using a heater.

2. Prior Art

Up until now, to operate a cryopump under good operational condition, various cryopumps have been proposed, such as described in Published Unexamined Japanese Patent Application No. 152353/1991 (H3-152353), Published Unexamined Japanese Patent Application No. 237275/1991 (H3-237275) and the like.

In the cryopump described in the Application No. 152353/1991, a driving current is supplied to a driving motor or an expander motor of an expander, and when a value of the driving current detected varies unusually, a correction signal related to the unusual variation of the driving current is output to an invertor, and a rotational speed in the driving motor is lowered. Therefore, the driving motor is driven stably, and a synchronism loss phenomenon thereof can be avoided.

In the cryopump described in Application No. 237275/1991, an inverter means of a driving motor or an expander motor in a refrigerator is controlled based on a temperature in a cooling stage or pressure in a vacuum chamber to be evacuated, and, thereby, the rotational speed in the driving motor is determined.

The operational principal of a cryopump is based on the adsorption and the condensation of gas, and operational characteristics (or operational performance) of the cryopump is essentially affected by the adsorption and condensation of gas in the past, i.e. by the operational history of the cryopump.

However, in the above prior art, the rotational speed of the expander motor is controlled based on only the operational conditions at that time without considering the past operational history of the cryopump. In other words, the control of the rotational speed of the cryopump is limited to only a real time control.

Therefore, the following problems arise.

(1) FIG. 4 shows a rotational speed of an expander motor with respect to an operation elapsed time of a cryopump operated under conventional real time control.

As shown in FIG. 4, the expander motor is initially operated at the highest speed to perform rapid cooling of the cryopump, and is then operated at a lower stable rotational speed after cooling of the cryopump. However, in the case where a sudden load change occurs in the cryopump (for example, in the case where a sputtering operation is performed in a vacuum chamber to which the cryopump is attached) as shown in FIG. 4 by arrows "a", to maintain a temperature or a pressure in the vacuum chamber at a constant level, the rotational speed in the expander motor rapidly changes each time sputtering is performed. Therefore, an excess load is applied to the expander motor. In addition, a material constituting a seal of an expander which is driven by the expander motor is adversely affected, and is rapidly worn. Therefore, the working of the expander motor is shortened.

FIG. 5 shows pressure variation in a vacuum chamber. As shown in FIG. 5, though a pressure in the vacuum chamber is normally set to be $10^{-9}$ torr, the pressure is temporarily increased to $2\times10^{-3}$ torr when sputtering is performed. Thus, at this time, as shown in FIG. 4 by arrows "a", the rotational speed of the expander motor is rapidly increased.

(2) The cryopump is utilized as a vacuum pump, and argon, water and hydrogen are adsorbed and accumulated on a cryopanel of the cryopump. Therefore, it is required to periodically remove the accumulated substance. In other words, a regeneration of the cryopump is required. Up until now, however, suitable time for maintenance work and checking for example, the regeneration of the cryopump cannot be properly determined. Therefore, the operational performance of the cryopump may suddenly deteriorate during operation, and the operation of the cryopump may be frequently stopped.

When deterioration of the operational performance of the cryopump suddenly occurs in a vacuum system such as a semiconductor manufacturing apparatus or the like, considerable damage can result.

(3) Deterioration of a cryopump with over time cannot be predicted or diagnosed, and, therefore, problems which may be caused by the deterioration of the cryopump with over time cannot be prevented.

(4) The reasonable and planned maintenance and checking adapted to each of various types of deterioration of the cryopump with over time cannot be performed. Therefore, wasteful maintenance and checking resulting in increased costs are required.

(5) To maintain the operational performance of a cryopump, which involves maintaining the temperature or pressure at a constant value, the cryopump is forcibly operated, and there is a probability that irreversible damage will occur.

Next, in usual two-stage cryopumps, a first stage cryopanel is maintained at a temperature of 50–100 K. to condense mainly water, and a second stage cryopanel is maintained at a temperature of 20 K. or lower to condense argon (Ar) and nitrogen ($N_2$) gases. Also, an activated charcoal layer or the like formed on the reverse side of the second stage cryopanel cryogenically adsorbs hydrogen ($H_2$) gas which cannot be condensed at temperatures of 20 K. or so and, thereby, a chamber is placed under vacuum.

A cryopump is a storage type vacuum pump as described above, and hence requires regeneration (release of condensed or adsorbed gases from a cryopanel) after running for a certain period of time. Since the chamber cannot be evacuated during regeneration, operation of a sputtering system and an ion implantation must be suspended. To improve availability of the systems, the regenerative time should be reduced to be as short as possible.

PCT Application Domestic Announcement No. 509144/1993 discloses a conventional regenerative technique for cryopanel surfaces of a cryopump run by a helium refrigerator. According to the regenerative technique shown, at the time of regenerating a cryopump, substances condensed/adsorbed on the cryopanel surface of a cryopump are changed in phase to a liquid phase and/or a gas phase, and the substances in the liquid phase and/or gas phase are exhausted from the cryopump for removal therefrom.

The prior art described above has an advantage of rapid regeneration because partial regeneration is employed, i.e. substances condensed/adsorbed on the second stage cryopanel surface of a cryopump are changed in phase to a liquid phase and/or a gas phase, and the substances in the liquid phase and/or gas phase are exhausted from the cryopump for removal therefrom. The regenerative method of the prior art, however, involves the following disadvantages (1)–(3).

(1) Due to partial regeneration, an internal temperature of a pump casing is maintained, during regeneration, below a temperature of melting and evaporating of water condensed on a cryopanel located at a first stage, i.e. the first stage cryopanel is not regenerated. However, in order to regenerate gases condensed or adsorbed on the second stage cryopanel, the pump casing temperature must be raised above a triple point of the gases. This causes the temperature of the first stage cryopanel to rise above that at the time of running as a cryopump. As a result, water condensed on the first stage cryopanel surface is caused to sublimate. According to the prior art described above, however, since the pump casing is evacuated only to a vacuum of 10 Pa or so after the regeneration, the sublimated water adsorbs, in the form of vapor ($H_2O$), on an activated charcoal layer provided on the back side of the second stage cryopanel. This causes the volume of adsorption of $H_2$ to decrease in the next exhausting operation.

(2) Since substances are exhausted in the liquid phase and/or gas phase, two waste systems, i.e. gas and liquid systems are installed to treat the exhausted substances. As a result, the equipment becomes complex with a resultant increase in costs. Also, the process of treating the exhausted substances becomes complex.

(3) There has been a limit to effect a reduction in regenerative time. That is, only the time of partial regeneration has been able to be reduced, but an entire regenerative time is not reduced.

Further, as stated above in a conventional cryopump, a working gas, typically, a helium gas, at room temperature and high pressure supplied from a compressor unit is adiabatically expanded by an expander driven by an expander motor so as to generate cryogenic temperatures. The first stage cryopanel is cooled to a temperature of from 50 to 100 K. by a cooling gas generated in a first stage expanding portion of a helium refrigerator. On the other hand, the second stage cryopanel is cooled to a temperature of from 10 to 20 K. by a cooling gas generated in a second stage expanding portion of the helium refrigerator.

In such a cryopump, water or the like is condensed on the first stage cryopanel which is cooled to a temperature of from 50 to 100 K., while a nitrogen ($N_2$) gas, an argon (Ar) gas or the like are condensed on the second stage cryopanel which is cooled to a temperature of from 10 to 20 K. A hydrogen ($H_2$) gas or the like, which cannot be condensed on the second stage cryopanel cooled to 10 K., is further cryogenically adsorbed onto an activated charcoal layer provided on the back surface of the second stage cryopanel. The cryopump is thus used for forming a high vacuum in a vacuum chamber for a sputtering system or an ion implantation.

A conventional cold trap generally has a single stage cryopanel and in which a working gas, typically, a helium gas, at room temperature and high pressure is supplied from a compressor unit to be expanded adiabatically by an expander driven by an expander motor so as to generate cryogenic temperatures. The cryopanel is cooled to a temperature of from 80 to 130 K. by a cooling gas generated in a single stage expanding portion of a helium refrigerator.

A cold trap is typically placed upstream of a turbo molecular pump and has the capability to improve the pumping speed of water, which otherwise hampers the discharge performance of the turbo molecular pump. The cold trap permits water or the like to be condensed on the cryopanel cooled to a temperature of from 80 to 130 K. so that it can be used to form a high vacuum in a vacuum chamber in a sputtering system or an ion implantation.

In these apparatuses employing a cryopump and a cold trap, for example, in sputtering apparatuses, it is very important to maintain the uniformity of the sputter film, which requires that the pumping speed of the cryopump and that of the cold trap be kept constant. This further necessitates that the surface(s) of the first and/or the second stage cryopanels of the cryopump and the surface of the cryopanel of the cold trap be maintained at predetermined temperatures.

Further, since the cryopump and the cold trap discharge gases from a vacuum chamber while storing them therein (storage type), it is necessary to regenerate the gases (outgassing) after each discharge operation for a certain period of time. In the regenerating process, outgassing is performed after a gas is discharged and stored. It is thus necessary to maintain the cryopanels of the cryopump at approximately room temperature when it is desired that a gas condensed or adsorbed onto the surfaces of both the first and second stage panels be completely regenerated (complete or full regeneration), and when it is desired that a gas on only the second stage cryopanel be regenerated (partial regeneration), it is necessary to maintain the cryopump at a temperature of from 120 to 150 K. On the other hand, since the gas on the cryopanel of the cold trap is regenerated while the turbo molecular pump is driven, it is necessary that the cryopanel of the cold trap be maintained at a temperature of from −10° to −30° C. since water is required to be sublimed to perform outgassing.

In the conventional regenerate method, whichever method is employed for performing regeneration, a heater is used for maintaining the cryopanels of both the cryopump and the cold trap at constant temperatures. However, it is troublesome and costly to build a heater, and to arrange a circuit for supplying a current to the heater in a small casing of a cryopump or a cold trap. Additionally, if a heater is provided for a cryopump and a cold trap accommodated in a casing which is transformed in a high vacuum state, it may generate a gas, which may further produce an adverse influence on the vacuum processing side. Further, the temperature of the entire cryopanel cannot be uniformly adjusted with the heater, which also adversely influences the pumping speed and performance. Also, a sufficient regenerating operation cannot be achieved, and such localized heating may give rise to problems.

Therefore, an object of the present invention is to avoid the drawbacks of such a conventional cryopump, and provide a cryopump in which a sudden load change of an expander motor can be avoided, an operation at an optimized condition can be performed, and a suitable time for maintenance and checking required e.g. for the regeneration can be predicted.

Further object of the present invention is to provide a regenerative method and apparatus for a cryopump capable of regenerating cryopanels in a short period of time.

A still further object of the present invention is to provide a cryopump and a cold trap which can maintain the surfaces of the cryopanels at predetermined temperatures without requiring a heater.

SUMMARY OF THE INVENTION

To solve the above problems, according to the first aspect of the present invention, a cryopump comprises a compressor unit for inhaling a low pressure working gas and discharging a high pressure environmental temperature working gas, an expanding portion driven by an expander motor for expanding adiabatically the high pressure environmental temperature working gas discharged from the compressor unit to generate a cryogenic temperature, the compressor unit and the expanding unit being connected to each other to form a closed circuit, and a cryopanel cooled by the cryogenic temperature generated by the expanding portion, characterized in that the cryopump further comprises:

detecting means for detecting an operation parameter at an elapsed operation time in a current operation cycle of the cryopump; storing means for storing a value of another operation parameter at a corresponding elapsed operation time in a past operation cycle of the cryopump as a management parameter; arithmetic controlling means for calculating a succeeding rotational speed of the expander motor based on the current operational parameter and the management parameter stored in the storing means and outputting the same as a driving instruction signal, with which a succeeding rotational speed of the expander motor is controlled so as to maintain a temperature of the cryopanel or a pressure in a vacuum chamber to which the cryopump is attached at a predetermined value by using a current rotational speed of the expander motor and a preceding rotational speed at the corresponding elapsed operation time in the past preceding operation cycle of the cryopump stored in the storing means as the management parameter, and expander motor driving means for driving the expander motor according to the driving instruction signal output from the arithmetic controlling means.

Also, according to a second aspect of the present invention, a cryopump comprises a compressor unit for inhaling a low pressure working gas and discharging a high pressure environmental temperature working gas, an expanding portion driven by an expander motor for adiabatically expanding the high pressure environmental temperature working gas discharged from the compressor unit to generate a cryogenic temperature, the compressor unit and the expanding portion being connected to each other to form a closed circuit, and a cryopanel cooled by the cryogenic temperature generated by the expanding portion, characterized in that the cryopump further comprises:

detecting means for detecting an operation parameter at an elapsed operation time in a current operation cycle of the cryopump; storing means for storing a value of a diagnosis parameter to judge a time for a maintenance or a regeneration of the cryopump; arithmetic controlling means for judging whether the cryopump is now in a maintenance time or the regeneration time by comparing the current operation parameter detected by the detecting means with the value of the diagnosis parameter stored in the storing means and outputting an alarm signal; and controlling means for displaying that the cryopump is now in a maintenance time or regeneration time based on the alarm signal output from the arithmetic controlling means.

In the cryopump according to a first aspect of the present invention, since the succeeding rotational speed of the expander motor is controlled so as to maintain a temperature of the cryopanel or a pressure in the vacuum chamber at a predetermined level by using the value of the management parameter representing performance of a past operation cycle, an unusual sudden change in the rotational speed of the expander motor is suppressed, and, therefore, operation of the cryopump is made smooth.

In the cryopump according to a second aspect of the present invention, since a regenerating time or a maintenance time of the expander motor can be predicted by using a diagnosis parameter, appropriate and planned maintenance and checking can be performed.

According to a third aspect of the present invention, there is provided a regenerative method for a cryopump having first and/or second stage cryopanel surfaces to condense and/or adsorb gases during pump operation and cooling means for cooling the cryopanel surfaces. On completion of releasing gases from the first stage cryopanel surface and/or second stage cryopanel surface by maintaining the cryopanel surface(s) at a fixed temperature, an internal pressure of the cryopump is quickly reduced to $1/10^3$ Pa (pascal) or less with the cryopanel surface(s) maintained at the fixed temperature. Then, the second stage cryopanel surface is quickly cooled to a temperature of 20 K. or lower.

According to a fourth aspect of the present invention, there is provided a regenerative apparatus for a cryopump having first and/or second stage cryopanel surfaces to condense and/or adsorb gases during pump operation and cooling means for cooling the cryopanel surfaces. The regenerative apparatus has heating means for heating the first and second stage cryopanel surfaces, temperature sensor for detecting a temperature of the cryopanel surfaces, pressure detecting means for detecting an internal pressure of the cryopump, control means for generating a control signal in response to an output from the temperature sensor and pressure detecting means, and pressure reducing means for reducing an internal pressure of the cryopump. On completion of releasing gases from the first stage cryopanel surface and/or second stage cryopanel surface, the control means causes the pressure reducing means to quickly reduce an internal pressure of the cryopump to $1/10^3$ Pa or less while controlling the heating means so as to maintain the cryopanel surfaces at the same temperature as in releasing gases. Then, the control means causes the cooling means to quickly cool the second stage cryopanel surface to a temperature of 20 K. or lower. The pressure reducing means may be a vacuum pump including a turbo-molecular pump. Also, quick cooling may be attained by increasing a rotational speed of an expander motor of a refrigerator.

According to the regenerative method and apparatus according to a third and a fourth aspects of the present invention, on completion of releasing gases from cryopanel surfaces, an internal pressure of a cryopump is quickly reduced to $1/10^3$ Pa or less with the cryopanel surfaces being maintained at the same temperature as in releasing gases, and then a second stage cryopanel surface is quickly cooled to a temperature of 20 K. or lower. That is, first, a pressure is reduced to a high vacuum to completely remove gases released from the cryopanel surfaces, and then the cryopanel surface is quickly cooled. As a result, the cryopanel surfaces maintain cleanliness and can be completely regenerated. Furthermore, since cooling down is attained in a short period of time, it is possible to reduce a regenerative time required until the cryopump resumes running.

According to a fifth aspect of the present invention, a cryopump includes a surface(s) of a first and/or a second stage cryopanel(s) onto which a gas is condensed and/or adsorbed during the operation of the pump, and cooling means for cooling the surface(s) of the first and/or the second stage cryopanel(s), the cooling means allowing a working gas at room temperature and high pressure supplied from a compressor unit to be expanded adiabatically by an expander driven by an expander motor so as to generate cryogenic temperatures, wherein the cryopump further comprises: a temperature sensor for detecting the temperature of the surface of the first stage cryopanel; and control means for allowing the expander to be suspended for a certain period of time or to be reversely rotated based on a detection signal from the temperature sensor, thereby controlling the surface temperature(s) of the first and/or the second stage cryopanel(s) to be within a predetermined range(s).

According to a sixth aspect of the present invention, a cold trap includes a surface of a single stage cryopanel onto which a gas is condensed during the operation of the pump, and cooling means for cooling the surface of the cryopanel, the cooling means allowing a working gas at room temperature and high pressure supplied from a compressor unit to be expanded adiabatically by an expander driven by an expander motor so as to generate cryogenic temperatures, wherein the cold trap further comprising: a temperature sensor for detecting the temperature of the surface of the cryopanel; and control means for allowing the expander to be suspended for a certain period of time or to be reversely rotated, based on a detection signal from the temperature sensor, thereby controlling the temperature of the surface of the cryopanel to be within a predetermined range.

When the expander of the cryopump or the cold trap is suspended, adiabatic expansion of a working gas does not occur, thus the generation of cryogenic temperatures by the cooling means ceases, resulting in an increase in the temperature. On the other hand, when the expander is reversely rotated, the refrigerating cycle of the cryopump and the cold trap is reversed, resulting in that the refrigerating cycle is substituted by a heating cycle. As a consequence, based on a detected output from the temperature sensor for detecting the temperature of the first stage cryopanel, the expander is suspended or reversely rotated, thereby maintaining the first and/or the second stage cryopanel(s) of the cryopump and that of the cold trap at a predetermined temperature(s) without requiring a heater.

The above and other objects, features and advantages of the present invention will become more apparent from the following description when taken in conjunction with the accompanying drawings in which preferred embodiments of the present invention are shown by way of illustrative examples.

BRIEF DESCRIPTION OF THE DRAWING

FIGS. 3A, 3B are a flow chart showing a control procedure of the cryopump performed by controller;

FIG. 11(*b*) is a top view illustrative of the same cryoturbo.

PREFERRED EMBODIMENTS OF THE INVENTION

Hereinafter, preferred embodiments of the present invention are described in detail with reference to drawings.

Figure 1:
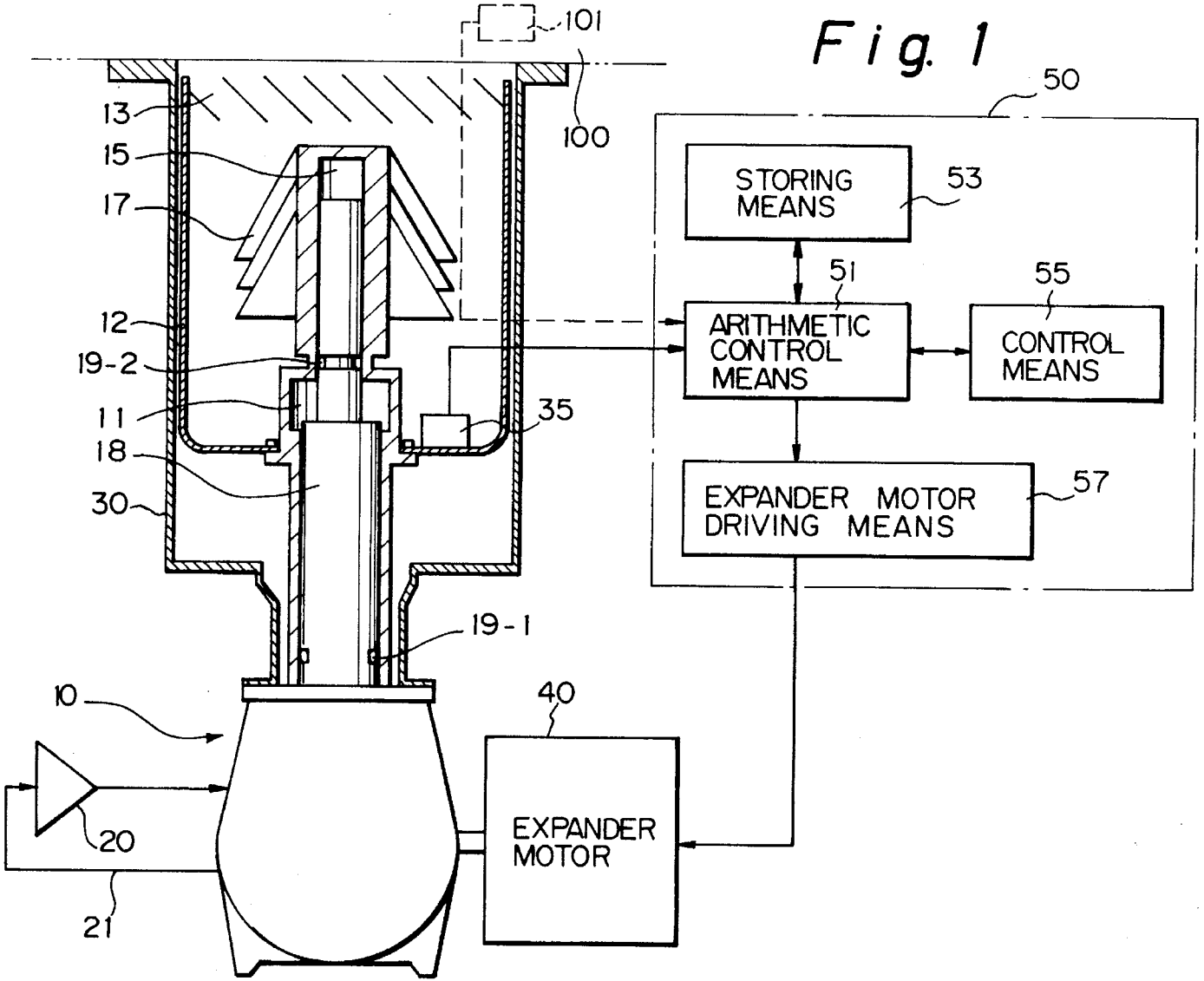
FIG. 1 is a constitutional view schematically showing a cryopump according to a first embodiment of the present invention.

FIG. 1 is a constitutional view schematically showing a cryopump according to a first embodiment of the present invention.

As shown in FIG. 1, a cryopump includes a refrigerator 10 and a compressor unit 20 connected to the refrigerator 10 through a piping 21. In the refrigerator 10, an expander 18 is moved up and down by an expander motor 40, and a first stage expanding portion 11 and a second stage expanding portion 15 are cooled to a cryogenic temperature. The compressor unit 20 is connected to the first stage expanding portion 11 and the second stage expanding portion 15 in a closed circuit form through the piping 21. Also, 19-1 denotes a first stage sealing portion of the expander 18, and 19-2 denotes a second stage sealing portion of the expander 18.

Also, a first stage cryopanel 13 is attached to an upper end of the first stage expanding portion 11 through a thermal transfer element 12, and a second stage cryopanel 17 is directly attached to the second stage expanding portion 15.

The first stage expanding portion 11 and the second stage expanding portion 15 are surrounded by a casing 30, and a vacuum chamber 100 is connected to an upper end of the casing 30.

Also, a temperature sensor 35 is attached to the thermal transfer element 12, and an output of the temperature sensor 35 is input to an arithmetic controlling means 51 of a controller 50. Alternatively, the temperature sensor 35 may be provided at the first stage cryopanel 13, the second stage expanding portion 15, or the second stage cryopanel 17.

Following mechanical movement of the cryopump is briefly described. A low pressure working gas, for example, helium gas, discharged from the refrigerator 10 to the piping 21 is converted to a high pressure room temperature working gas by the compressor unit 20, and the high pressure room temperature working gas is fed to the refrigerator 10. Thereafter, the high pressure room temperature working gas fed to the refrigerator 10 is expanded in the first stage expanding portion 11 and the second stage expanding portion 15 by the expander 18 which is placed in the refrigerator 10 and is driven by the expander motor 40, and the first stage expanding portion 11, the second stage expanding portion 15, the thermal transfer element 12, the first stage cryopanel 13 and the second stage cryopanel 17 connected to the expanding portion 11 and 15 are cooled by the expanded working gas.

Therefore, gas molecules in the vacuum chamber 100 are condensed or adsorbed on surfaces of the first stage cryopanel 13 and the second stage cryopanel 17, and a gas in the vacuum chamber 100 is evacuated.

In this case, surface temperatures of the first stage and second stage cryopanels 13, 17 are controlled by controlling a rotational speed of the expander motor 40.

Figure 2:
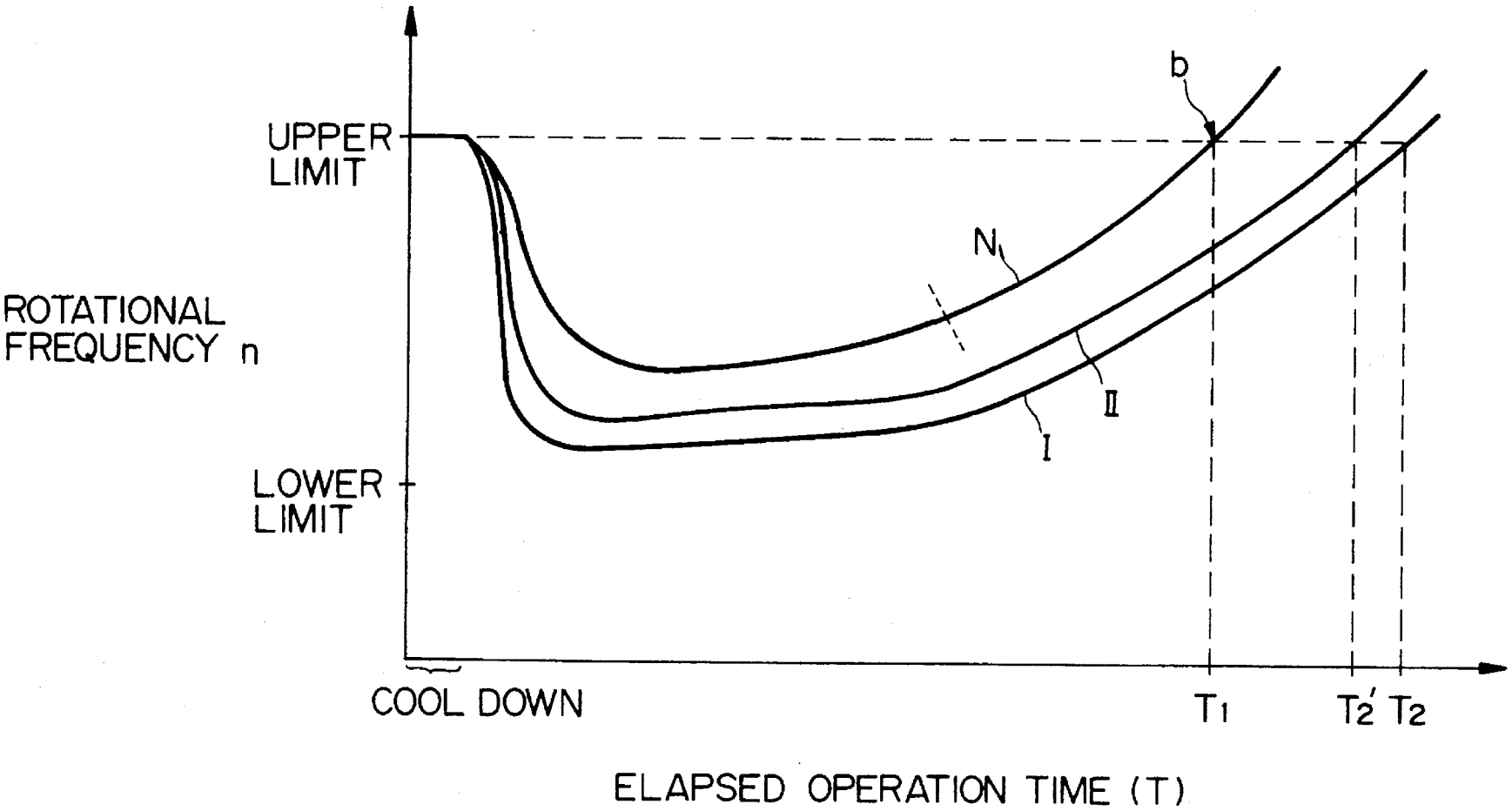
FIG. 2 is a view showing a rotational frequency n in the expander motor with respect to the elapsed operation time T on condition that the cryopump is attached to the vacuum chamber and the cryopump is operated to maintain a temperature of the cryopump at almost a constant value.

FIG. 2 shows a rotational speed (frequency n) in the expander motor with respect to an elapsed operation time T on condition that the cryopump is attached to the vacuum chamber 100 for a sputtering apparatus or the like and the cryopump is operated to maintain a temperature of the cryopump at an almost constant value, or to maintain a pumping speed of the cryopump at a constant value, that is, to maintain an adsorbing rate of gas molecules to the surfaces of the cryopanels at a constant value.

In FIG. 2, a first operation cycle, wherein the cryopanels 13 and 17 are in a non-contaminated condition, is indicated by a line I. In the operation cycle I, the expander motor 40 is operated at a rotational speed close to its upper limit to cool the cryopump near a first time (T=0) of an elapsed operation time T.

Thereafter, the rotational speed of the expander motor 40 is decreased as the temperature of the cryopanels is lowered. Thereafter, the rotational speed is stabilized. Since the number of gas molecules adsorbed on the surfaces of the cryopanels 13 and 17 increases, and thereby a refrigerating performance of the cryopump is gradually decreased, the rotational speed of the expander motor 20 must be gradually increased, to maintain the temperature at a constant value.

Thereafter, regeneration is needed for the cryopump at an elapsed operation time T2 at which the rotational speed of the expander motor 40 reaches its upper limit. However, regeneration of the cryopump is normally performed at a target exchanging time T1 at which a target must be exchanged in the sputtering apparatus.

Here, regeneration means that gas molecules condensed or adsorbed on the surfaces of the cryopanels 13 and 17 are released while raising the temperature of the cryopanels 13 and 17. However, 100% of the gas molecules adsorbed cannot be released, and a number of gas molecules so adsorbed remain on the cryopanels.

After the regeneration of the cryopump, operation of the cryopump is restarted. Then, a flowing rate of the gas in the sputtering apparatus is almost the same as in the first operation cycle. Therefore, the expander motor 40 is operated in almost the same manner as in the first operation cycle. However, as compared with the first operation cycle, because a few gas molecules adsorbed on the surfaces of the cryopanels 13 and 17 remain and because the performance of the cryopump tends to deteriorate due to the degradation on the surfaces of the sealing portions 19-1 and 19-2, the rotational speed must be slightly increased in principle. Thus, a second operation cycle is indicated by a line II as shown in FIG. 2. In FIG. 2, for convenience of explanation, the lines I and II are drawn as if the line I is located far from the line II. However, in actuality the line I is close to the line II.

In the second operation cycle, an elapsed operation time at which the rotational speed of the expander motor 20 reaches its upper limit is indicated by T'2.

As is described above, the rotational speed or frequency n of the expander motor 20 is as a whole gradually increased each time the operation cycle of the cryopump is added. Therefore, when the target exchanging time T1 coincides with an operation elapsed time at which the rotational speed of the expander motor 20 reaches its upper limit, it should be made to be a maintenance time for the cryopump (a point b). In FIG. 2, the maintenance time comes in an operation cycle N. Before the maintenance time defined above, the sealing portions 19-1 and 19-2 of the expander 18 are normally operated. However, there is a case that the sealing portions 19-1 and 19-2 may be rapidly worn before the maintenance time. In this eventuality, the maintenance of the cryopump is performed at an earlier time.

As is described above, the operational characteristics (or performance) of the cryopump essentially changes according to the past operation history of the cryopump. Therefore, in this invention, the cryopump is controlled by taking such a change in operation characteristics into consideration.

Hereinafter, contents of the specific control performed by the invention is described.

As shown in FIG. 1, a controller 50 comprises the arithmetic controlling means 51 comprising a micro processor, a storing means 53 comprising a read only memory (ROM) such as an electrically programmable ROM or an electrically erasable and programmable ROM, a random access memory (RAM) or the like, a control means 55 having a displaying section such as a cathode-ray tube (CRT) or the like and an input section such as a keyboard or the like, and an expander motor driving means 57 for outputting a rotation driving pulse according to a driving instruction signal sent from the arithmetic controlling means 51 to drive the expander motor 40.

Next, a control procedure of the cryopump is described.

Figure 3B:
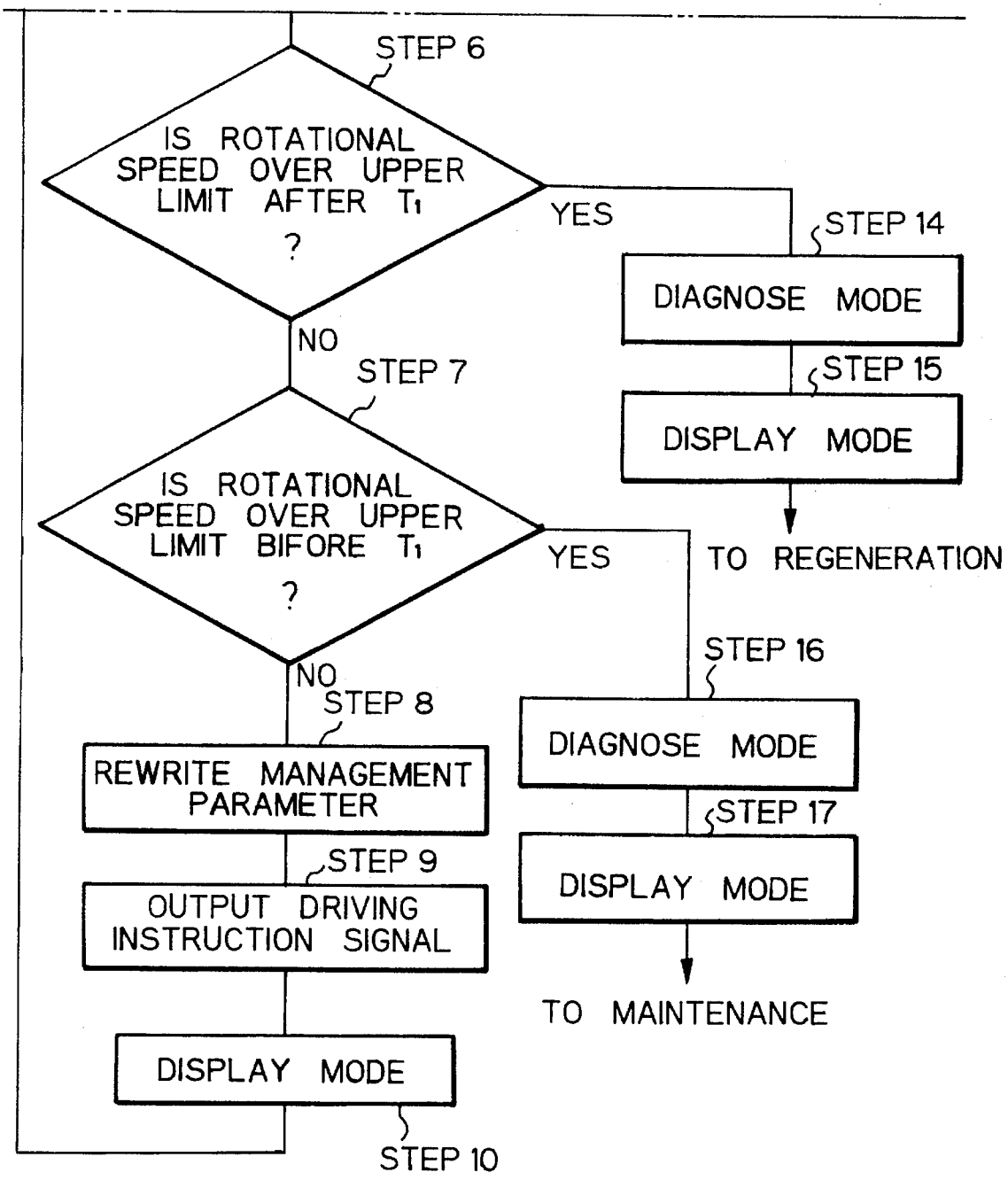

Speed Control of Expander Motor:

FIG. 3 is a flow chart showing a control procedure of the cryopump performed by the control section 50.

Initially, data contents of the first operation cycle, that is, the operation cycle I shown in FIG. 2 are stored in the storing means 53 as a management parameter. In this case, the data contents of the operation cycle I to be stored would vary depending on a temperature K (kelvin) of the cryopanels 13 and 15 and a condition in the vacuum chamber 100.

Thereafter, an initial driving instruction signal is output from the arithmetic controlling means 51 to the expander motor driving means 57, and driving of the expander motor 40 is started (step 1).

The refrigerator 10 is cooled by the driving of the expander motor 40. Thereafter, a current temperature of the refrigerator 10 is detected by a temperature sensor 35, and a value of the current temperature and a current rotational speed of the expander motor 40 are input to the arithmetic controlling means 51 of the controller 50 as a current operation parameter (step 2).

Thereafter, a rotational speed of the expander motor 40 at a corresponding elapsed operation time of the management parameter is read from the storing means 53 to the arithmetic control means 51 (step 3).

Thereafter, a next rotational speed of the expander motor 40 (e.g. five minutes later) in the current operation cycle is calculated from the current operation parameter, that is, the current temperature and the current rotational speed, and a rotational speed in the management parameter read from the storing means 53 in step 3 (step 4).

Thereafter, the next rotational speed calculated is compared with a rotational speed of the management parameter read from the storing means, and it is judged whether or not the next rotational speed calculated is out of a first permissible range from the rotational speed of the management parameter. In this case, the first permissible range is so predetermined that the next rotational speed will substantially follow the rotational speed in the expander motor 40 shown in FIG. 2. This judgement is performed to confirm that the current rotational speed does not unusually deviate from that of the management parameter.

Figure 4:
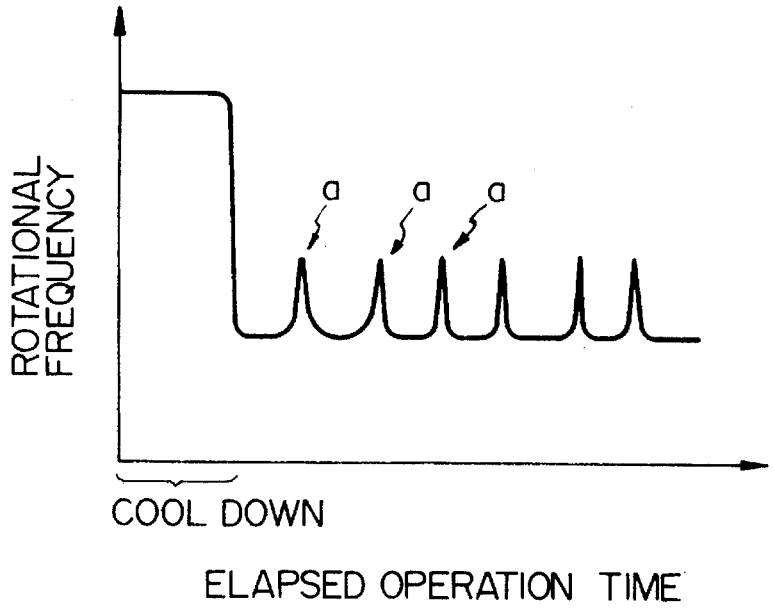
FIG. 4 is a view showing a rotational frequency n in an expander motor according to a prior art with respect to the elapsed operation time.
Figure 5:
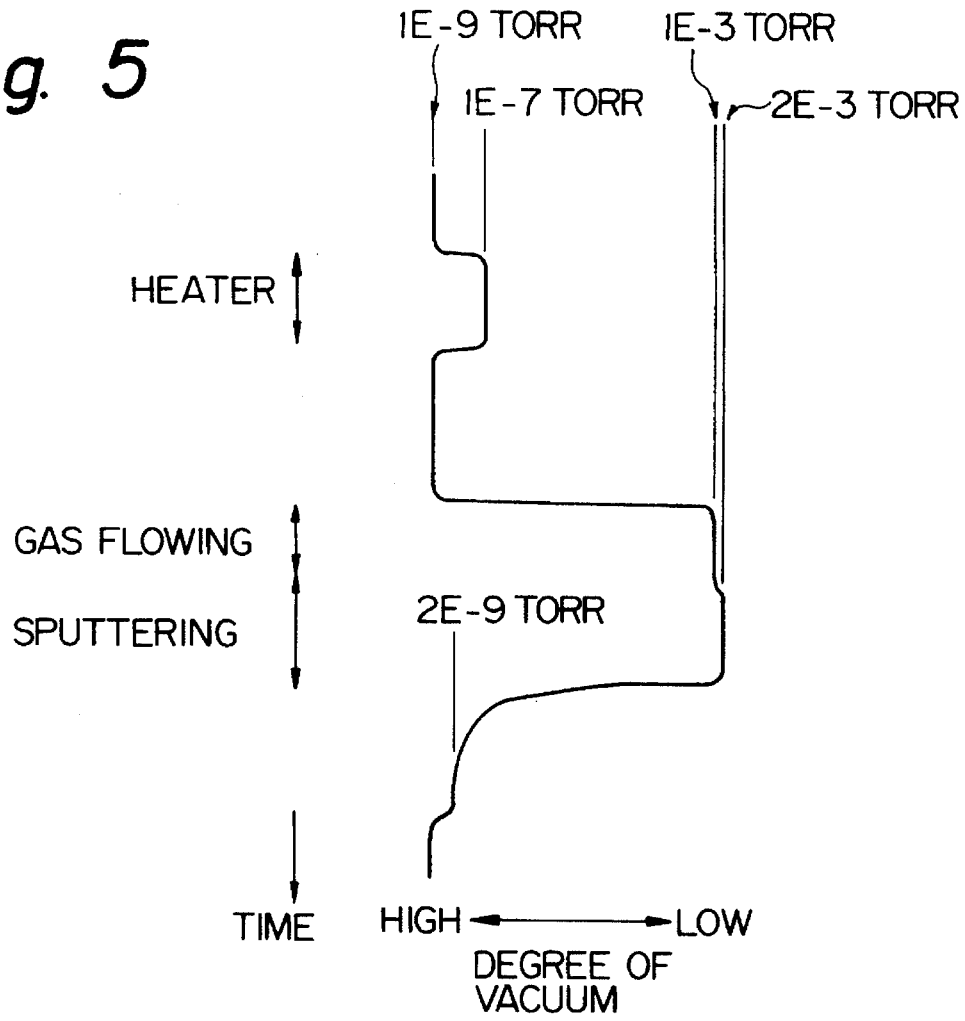
FIG. 5 is a view showing the pressure variation conditions in the vacuum chamber.

Thereafter, the next rotational speed calculated is compared with a just-prior rotational speed, for example, a rotational speed at a time just before five minutes in the current operation cycle, and it is judged whether or not the next rotational speed calculated is out of the second permissible range therefrom. The second permissible range differs from the first permissible range. This second judgment is performed to confirm that the next rotational speed calculated does not unusually deviate from the line of the current operation cycle. More specifically, for example, when a sputtering operation is performed in the vacuum chamber, the temperature in the vacuum chamber is temporarily raised and, therefore, the next rotational speed calculated may be accordingly unusually high as shown in FIG. 4. This second judgement is performed to avoid such a temporal fluctuation in the rotational speed.

In addition, the next rotational speed calculated is judged as to whether it is within a third permissible range to determine whether expander motor 40 is operating normally or not. A rotational frequency of the expander motor 40 under normal operation never exceeds the range of 40–90 rpm. Thus, the third permissible range may be set to be within a normal rotational frequency of the expander motor 40 (step 5).

In the case where the next rotational speed calculated is within the first, second and third permissible ranges, and the rotational speed does not exceed the upper limit (steps 6, 7) then the data stored in the storing means 53 is rewritten to adopt the next rotational speed calculated as a rotational speed at the corresponding elapsed time of the management parameter (step 8). That is, the next rotational speed calculated is utilized as the management parameter in the next operation cycle.

Thereafter, a driving instruction signal is output from the arithmetic control means 51 to the expander motor driving means 57 to control the speed of rotations of the expander motor to the next rotational speed calculated (step 9). Thereafter, a current operation mode, for example, a current temperature, an operation elapsed time and the like, is output from the arithmetic control means 51 to the control means 55 and is displayed (step 10).

Thereafter, the procedure returns to the step 2, and the above processing is repeated. This repetition is, for example, performed every five minutes, until the calculated rotational speed reaches a maximum rotational speed.

In contrast, in a case where it is judged in the step 5 that the next rotational speed calculated is not within the first, second or third permissible ranges, it is further judged whether or not the above judgement that the calculated speed is out of permissible range is consecutively repeated a predetermined number of times (step 11). In cases where the above judgement is consecutively repeated a predetermined number of times, operation of the cryopump is judged to be defective, and the procedure proceeds to a step 12. In cases where the above judgement is not repeated a predetermined number of times, it is judged that the cryopump is not operating defectively, and a rotational speed at the corresponding elapsed time of the management parameter or another rotational frequency close to the rotational speed is adopted as the next rotational speed calculated, and the procedure proceeds to step 8 through steps 6 and 7.

The reason why the cryopump is judged not to be defective when the judgement is not repeated predetermined number of times in the step 11 is as follows. There is a case that temperature of the cryopanels 13 and 15 is temporarily raised because a sputter is, for example, performed during the operation of the cryopump as stated above. In this case, a rotational speed calculated based on the raised temperature detected would be unusually high (as a phenomenon shown by the arrows in FIG. 4). In this case, however, the cryopump is not actually operating defectively. Therefore, even if the rotational speed calculated is once or twice out of the first, second or third permissible range, the cryopump may be operating normally. Also, this temperature change is temporary. Therefore, the number of times that the rotational speed calculated is out of the first, second or third permissible range is counted and, in a case where the number is equal to or less than a prescribed number, it is judged that the cryopump is operating normally in step 11.

In contrast, in a case where the rotational speed calculated is consecutively out of the first, second or third permissible range more than predetermined time, the cryopump is apparently in a defective state involving, for example, a problem in a seal mechanism of the cryopump or the like. As such, a maintenance will be needed. Therefore, in this case, an unusual mode is diagnosed (a step 12), an alarm signal is output to the control means 55, and the unusual mode diagnosed is displayed in the control means 55 (step 13). Thereafter, for example, an alarm signal is output to a sputtering apparatus to cease operation, and further the expander motor may be stopped. Instead, the procedure after step 10 may be manually performed.

As is described above, a value of an operation parameter in a preceding operation cycle is stored as a management parameter, and when a rotational speed of the expander motor is calculated, a rotational speed of the management parameter is utilized in the calculation and the rotational speed of the expander motor is controlled to maintain a temperature of the cryopanels at a predetermined level. Therefore, unnecessary abrupt changes in the rotational speed of the expander motor such as shown in FIG. 4 are suppressed, and proper operation of the cryopump can be facilitated.

Also, because an unusual condition of the cryopump is judged by checking whether or not a current operation parameter is unusually changed as compared with the rotational speed of the management parameter, the judgement can be precisely performed. In contrast, in a conventional art in which only a real time control is performed, when temperatures of the cryopanels are not lowered to a set value due to e.g. seal failure, the expander motor is operated for a long time at a rotational speed close to its upper limit to obtain an operation performance of the cryopump. In addition, deterioration of the cryopump cannot be predicted and the type of a failure mode cannot be diagnosed. Thus, there is a probability that the expander motor will be damaged.

In the above embodiment, a parameter of a one-time preceding operation cycle just before a current operation cycle is utilized as the management parameter. However, it is applicable that a parameter of a more-times preceding operation cycle may be used as the management parameter.

Also, in the above embodiment, the rotational speed, the elapsed operation time and the temperature are utilized as the operation parameter and the management parameter. However, it is possible that a pressure of the cryopump is utilized in place of the temperature. In this case, a pressure sensor 101 is provided in the vacuum chamber 100 and a rotational speed in the expander motor 40 is controlled so that the pressure in the vacuum chamber 100 is maintained at a predetermined value, in a similar manner as in the above embodiment.

Also, in the above embodiment, the temperature is maintained at a constant value. However, it is apparent that when gas molecules are accumulated on the cryopanel to a certain thickness, it decreases a pumping speed of the cryopump. Therefore, the temperature should be controlled to be decreased little by little to maintain a pumping speed of the cryopump at a constant value.

Diagnosing Control:

Next, a method for diagnosing and displaying a regeneration time or a maintenance time of the cryopump is described.

Determination of Regeneration Time:

As shown in FIG. 2, as the elapsed operation time T goes by, the rotational speed or frequency n of the expander motor 40 is gradually increased in any of the operation cycles. When the rotational speed exceeds an upper limit of the rotational speed (or a little lower than the upper limit), the cryopump reaches a time for regeneration. Therefore, the upper limit of the rotational speed of the expander motor 40 or a rotational speed a little lower than the upper limit of the rotational speed is stored in the storing means 53 in advance as a diagnosis parameter, and a current rotational speed calculated is compared with the rotational speed of the diagnosis parameter stored in the storing means 53. When the current rotational speed calculated exceeds the rotational speed of the diagnosis parameter, it is determined that the cryopump requires regeneration, an alarm signal is output to the control means 55, and a regeneration mode is displayed step (14, 15) in the control means 55 as shown in a flow chart shown in FIG. 3.

Determination of Maintenance Time:

When the operation cycle is repeated, as shown in FIG. 2, the rotational speed is as a whole gradually increased, and the rotational speed calculated ultimately reaches its upper limit before the target time T1 i.e. the time for exchanging a target (the operation cycle N in FIG. 2). In this case, since the cryopump cannot be operated to provide a prescribed refrigeration level, maintenance is needed. Therefore, it is necessary to inform an operator that maintenance is required.

Therefore, the target time T1 and the upper limit of the rotational speed in the expander motor 40 are stored in advance in the storing means 53 as the diagnosis parameter. The rotational speed calculated is compared with the diagnosis parameter stored in the storing means 53 and, when the rotational speed of the expander motor calculated reaches the upper limit of the rotational frequency or a rotational frequency close to the upper limit of the rotational frequency before the target time T1, then, it is determined that maintenance is required. Then, an alarm signal is output to the control means 55, and a maintenance mode is displayed (steps 16, 17) as shown in a flow chart shown in FIG. 3.

As for the maintenance time in other cases, for example, a sudden increase in an inner temperature or pressure due to e.g. a seal failure may be used as a diagnosis parameter. In this case, an amount of deviation of the rotational speed in a current operation cycle from the rotational speed in a preceding operation cycle at a corresponding elapsed operation time, or an amount of deviation of a current rotational speed from a rotational speed just before the current rotational speed is also large. In this case, an amount of deviation of a temperature, an amount of deviation in a pressure and an amount of deviation in a rotational speed, which are large enough to need a maintenance work for the cryopump, are stored as the diagnosis parameter in the storing means 53, and these amounts of deviation are compared with a deviation in current detected temperature, a current detected pressure and a current detected rotational speed. Thereafter, it is diagnosed whether or not a maintenance work is required. In the case where maintenance work is required, an alarm signal is output to the control means 55, and a maintenance mode is displayed in the control means 55.

It is apparent that either the speed control or the diagnosis control could be applied for the cryopump. Also, it is apparent that the speed control and the diagnose control could be applied for the cryopump together.

In the above embodiment, the temperature or the pressure is utilized as the diagnosis parameter, as an example. However, it is applicable that a vibration frequency of the cryopump be utilized as the diagnosis parameter. In this case, a vibration sensor is provided at a prescribed position of the cryopump. When a vibration frequency in a current operation cycle unusually deviate from a preceding vibration frequency at a corresponding elapsed operation time in a preceding operation cycle, it is judged that the cryopump is in an unusual state, and an alarm signal is output to the control means 55, and unusual condition mode is displayed in the control means 55.

Also, in another case, a predetermined total operation time for the cryopump is stored as a diagnosis parameter in the storing means 53. When the actual total operation time reaches a predetermined time, it is judged that the cryopump requires maintenance, and an alarm signal is output to the control means 55, and maintenance mode is displayed in the control means 55.

As is described above in detail, the cryopump according to the above described embodiments have superior effects as follows.

(1) Because not only real time control is used but also management parameters are utilized to control the current rotational speed of the expander motor, even if a sudden load change occurs for a short period in the cryopump (for example, the sudden load change occurs when a sputtering operation is performed in the vacuum chamber to which the cryopump is attached), the rotational speed in the expander motor does not fluctuate, and stable operation can be realized.

(2) The regeneration time and the maintenance time can be easily determined in advance, and deterioration with the passage of time can be forecasted. Further, forecast and diagnosis of the failure of the cryopump can be easily performed. Accordingly, the reasonable and planned maintenance and checking can be performed for the cryopump.

(3) The forcible or undue operation of the cryopump to keep the operation performance (for example, to keep the temperature or the pressure at a constant value) of the cryopump can be avoided.

Figure 6:
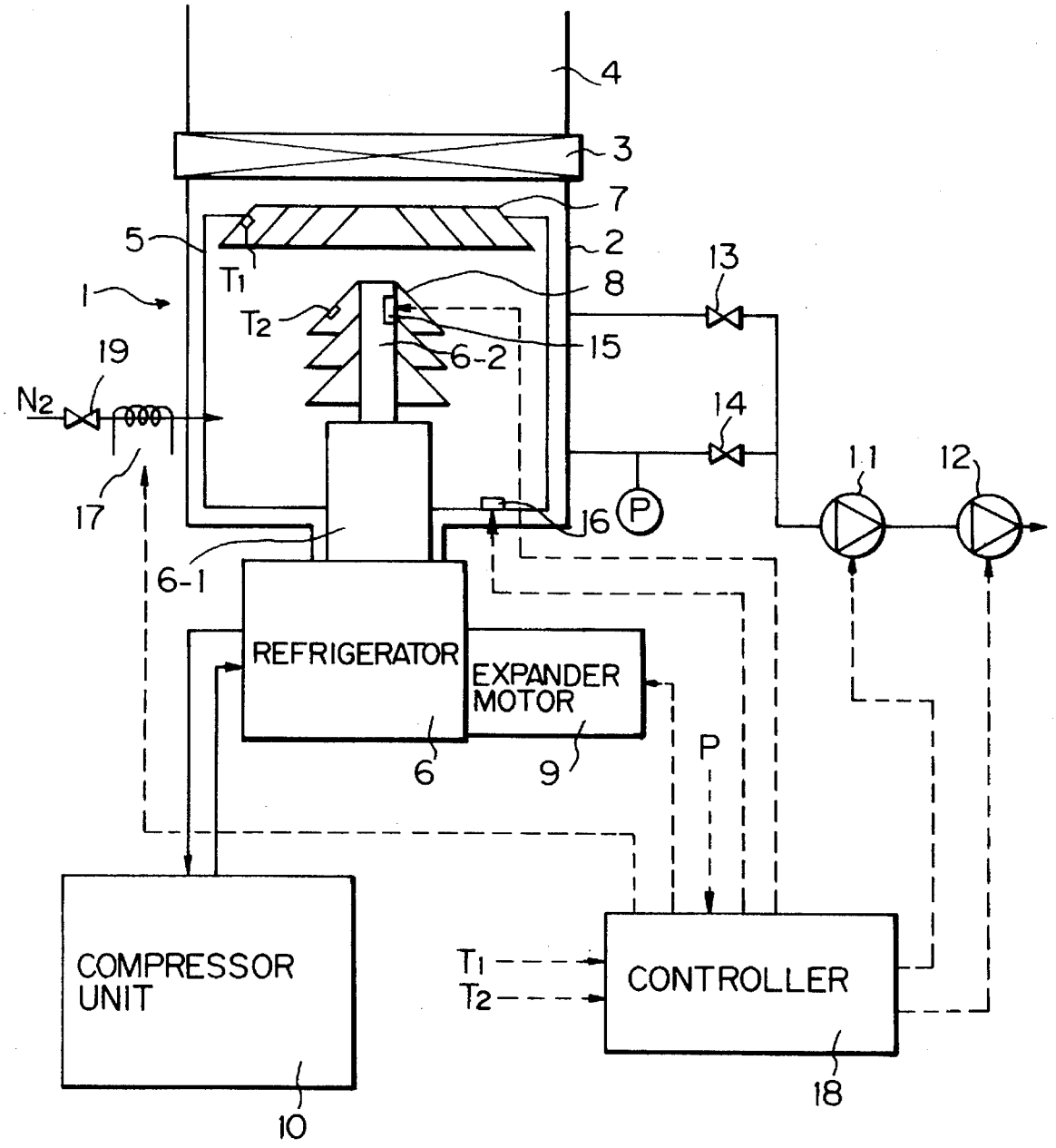
FIG. 6 is a diagram showing the construction of a regenerative apparatus for a cryopump for carrying out a regenerative method of the present invention.

Regeneration of Cryopump:

FIG. 6 is a view showing the construction of a regenerative apparatus for a cryopump which carries out a regenerative method of the present invention. A pump casing 2 of a cryopump 1 is connected to a vacuum chamber 4 through an inlet valve 3. First stage 6-1 and second stages 6-2 of a refrigerator 6 are arranged within the pump casing 2. A first stage cryopanel 7 is formed of metal plates which are shaped like a lamp shade and arranged horizontally in an overlapping manner. The first stage cryopanel 7 is located near the inlet valve 3 and connected to the first stage 6-1 of the refrigerator through a heat transfer element 5. A second stage cryopanel 8 is also formed of metal plates which are shaped like a lamp shade and arranged vertically in an overlapping manner. The second stage cryopanel 8 is located underneath the first stage cryopanel 7 and connected to the second stage 6-2 of the refrigerator.

A compressor unit 10 and an expander motor (consisting of a synchronous motor) 9 are connected to the refrigerator 6. As the expander motor 9 is operated, an expander is moved up and down. In synchronism with the expander's movement, a high-pressure helium gas is fed from the compressor unit 10 to the first stage 6-1 and second stage 6-2 of the refrigerator 6 for adiabatic expansion of gas, and the pressure reduced low-pressure helium gas is returned to the compressor unit 10. This causes the first stage 6-1 and second stage 6-2 of the refrigerator to be cooled and the surfaces of the first stage cryopanel 7 and second stage cryopanel 8 are cooled to a cryogenic temperature. At this cooling step, the first stage 6-1 of the refrigerator 6 is cooled at a temperature of 60–100 K., and the second stage 6-2, 12–20K.

By opening the inlet valve 3, gases in the vacuum chamber are allowed to flow into the pump casing 2. Instantaneously, for example, water ($H_2O$) adsorbs (condenses) on the first stage cryopanel 7, the argon gas (Ar) condenses on an upper surface of the second stage cryopanel 8, and the hydrogen gas adsorbs on an activated charcoal layer provided on the back side of the second stage cryopanel 8. Thus, various gases within the vacuum chamber 4 are removed.

Reference numeral 11 denotes a turbo-molecular pump, and 12 indicates a roughing vacuum pump. The turbo-molecular pump 11 and the roughing vacuum pump 12 are connected in series and are connected to the pump casing 2 through a relief valve 13 and a regeneration valve 14, both arranged in parallel to each other. Symbol P denotes a pressure sensor to detect an internal pressure of the pump casing 2; T1, a temperature sensor to detect a temperature of the first stage cryopanel 7; T2, a temperature sensor to detect a temperature of the second stage cryopanel 8; and reference numerals 15, 16, and 17 indicate a heater.

Reference numeral 18 denotes a controller. Outputs from the temperature sensors T1, T2 and pressure sensor P are inputted to the controller 18. The controller 18 supplies a driving power to the turbo-molecular pump 11 and roughing vacuum pump 12, a heating power to the heaters 15, 16, and a power to the heater 17 for heating the nitrogen gas ($N_2$) for use in purge.

In the regenerative apparatus for a cryopump in the construction described above, during regeneration, first, the inlet valve 3 is closed. Then, the refrigerator 6 is stopped, and a power is supplied to the heaters 15, 16, 17. Also, the valve 19 is opened to supply the pump casing 2 with the nitrogen gas ($N_2$) heated by the heater 17 for purging. This heating causes gases condensed/adsorbed on the first and second stage cryopanels 7, 8 to evaporate. When an internal pressure of the pump casing 2 exceeds the atmospheric pressure, the relief valve 13 opens to maintain the internal pressure of the pump casing 2 substantially at atmospheric pressure or higher. This causes substances adhering to the surfaces of the first stage cryopanel 7 and second stage cryopanel 8 to gasify and the gasified substances are exhausted from the pump system.

At this stage of regeneration, the condensed/adsorbed substances should be completely gasified and exhausted from the pump system. To this end, heating temperatures for the first stage cryopanel 7 and second stage cryopanel 8 are set according to condensed/adsorbed substances to be gasified. Power supplied from the controller 18 is controlled so that outputs from the temperature sensors T1, T2 reach set temperatures. Also, the time required for complete gasification (heating time) is set with respect to the quantity of adsorbing substances.

When the release of gases from the surfaces of the first stage cryopanel 7 and second stage cryopanel 8 has ceased indicating completion of regeneration, the regeneration valve 14 is opened while maintaining the first stage cryopanel 7 and second stage cryopanel 8 at the set temperatures above. The turbo-molecular pump 11 and the roughing vacuum pump 12 are run to reduce an internal pressure of the pump casing 2 to $1/10^3$ Pa or less. This pressure reduction is intended to clean the activated charcoal layer provided on the back side of the second stage cryopanel 8 and also to check for a leak within the pump casing 2. When evacuation is effected only through the roughing vacuum pump 12 a vacuum can be attained only on the order of 1/10 Pa even when the evacuation is continued for a long period of time. As a result, gases remain within the pump casing 2 and adsorb on the activated charcoal layer.

Next, the refrigerator 6 is run to cool the first stage cryopanel 7 to a surface temperature of 80 K. or less and to cool the second stage cryopanel 8 to a surface temperature of 20 K. or less. In this cooling, the expander motor 9, a synchronous motor, is run at a maximum rotational speed (for example 90 rpm) for quick cooling. A microprocessor in the controller 18 processes outputs from the temperature sensors T1, T2 and pressure sensor P to issue control signals. The heaters 15, 16, 17, expander motor 9, regenerative valve 14, roughing vacuum pump 12, turbo-molecular pump 11 and the like are automatically run and controlled based on the control signals.

The above described construction and operation have covered complete or full regeneration where the first stage cryopanel 7 is also heated to remove water. However, the method of the invention is applicable in partial regeneration where only the second stage cryopanel 8 is heated. Then, it is not necessary to stop running the refrigerator 6, and the heaters 16, 17 are put in OFF.

Heating temperatures to be set for the first stage cryopanel 7 and second stage cryopanel 8 at regeneration are listed below for reference to the substances to be removed.

TABLE 1

| | |
|---|---|
| Water vapor ($H_2O$) | About 300 K. (first stage cryopanel 7 and second stage cryopanel 8 are heated) (complete regeneration) |
| Argon (Ar) | 110–160 K. (only second stage cryopanel 8 is heated) (partial regeneration) |
| Hydrogen ($H_2$) | 30–80 K. (only second stage cryopanel 8 is heated) (partial regerneration) |
| Nitrogen ($N_2$) | 100–140 K. (only second stage cyropanel 8 is heated) (partial regeneration) |

Figure 7:
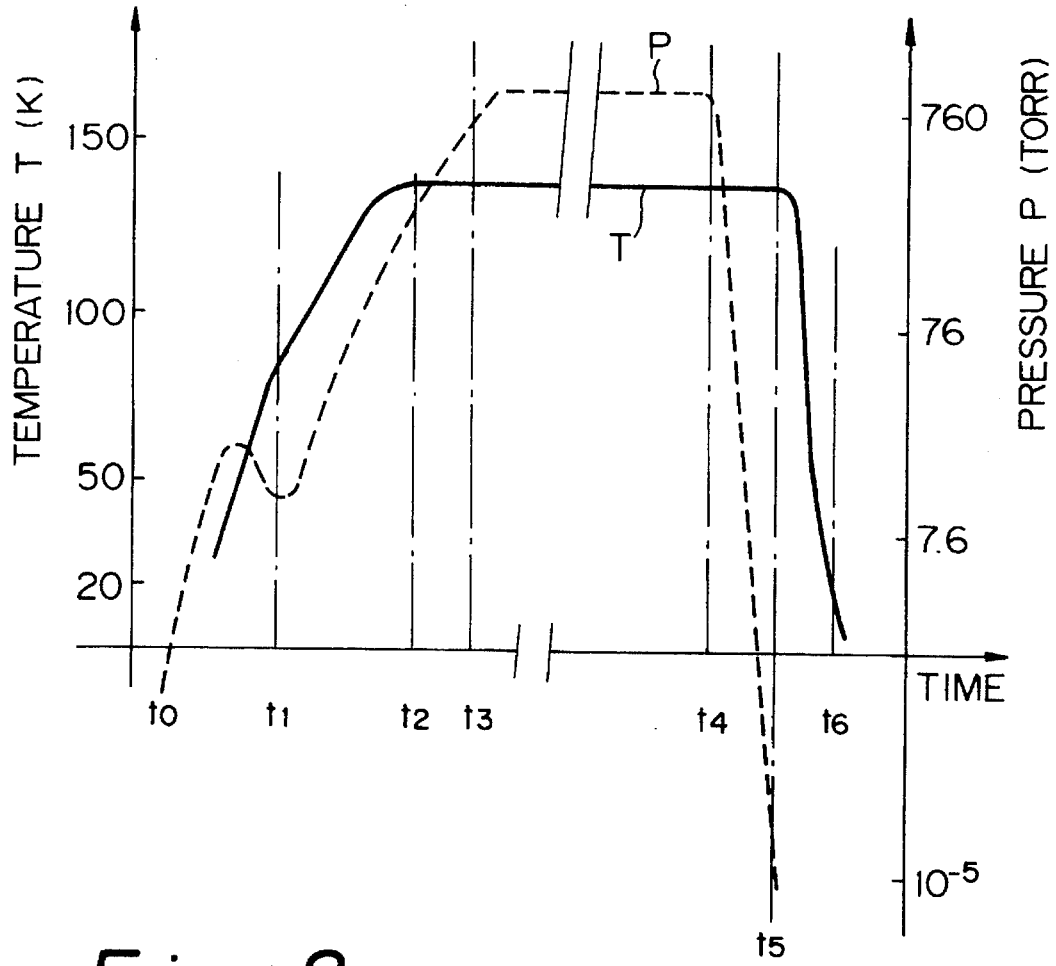
FIG. 7 is a graphical representation showing Ar regenerative processing procedure of the present invention.
Figure 8:
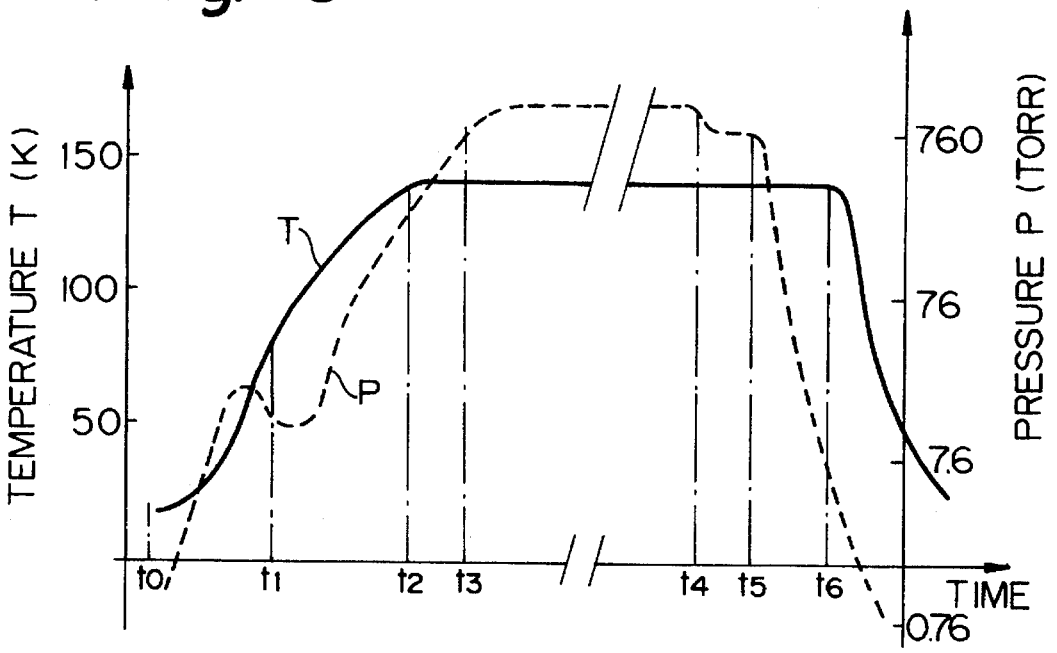
FIG. 8 is a graphical representation showing known Ar regenerative processing procedure.

FIG. 7 is a graphical representation of partial regeneration showing Ar regenerative processing procedure of the present invention. FIG. 8 is a graphical representation showing Ar regenerative processing procedure disclosed in PCT Application Domestic Announcement No. 509144/1993. In FIGS. 7 and 8, curve T represents a temperature of the second stage cryopanel, and curve P, an internal pressure of the pump casing. According to the Ar regenerative processing procedure of the present invention, as shown in FIG. 7, the turbo-molecular pump 11 and roughing vacuum pump 12 are run at time $t_4$ when the release of gases from the second stage cryopanel 8 has ceased, thereby quickly reducing an internal pressure of the pump casing 2 to $1/10^3$ Pa or less.

At time $t_5$ when an internal pressure of the pump casing 2 has reached $1/10^3$ Pa or less, the second stage cryopanel 8 is quickly cooled to a surface temperature of 20 K. or less. During the time span between times $t_4$ and $t_5$, the surface of the second stage cryopanel 8 is maintained at a fixed temperature (approximately 140 K.; a different temperature is employed for water vapor, hydrogen nitrogen, or the like). It's also possible that the starting of the cooling of the surface of the second stage cryopanel 8 is somewhat delayed beyond time $t_5$.

On the other hand, according to the known regenerative processing procedure disclosed in PCT Application Domestic Announcement No. 509144/1993, as shown in FIG. 3, ceasing of heating of the cryopanel surface is somewhat delayed than that of the present invention and is brought into effect at time $t_6$, and cooling of the cryopanel surface does not start until an internal pressure of the pump casing 2 becomes about 10–100 Pa.

As described above, in the known regenerative processing procedure, when the cooling of the cryopanel surface is started, an internal pressure of the pump casing 2 is still high at 10–100 Pa. This causes cryogenic adsorption to take place on the cryopanel surface and make it difficult to attain clean surface. By contrast, in the present embodiment, the pressure is reduced to $1/10^3$ Pa to completely exhaust gasified substances from the pump casing, and then cooling of the surface of the second stage cryopanel 8 starts. As a result, cleanliness within the pump casing is maintained, and the surface of the second stage cryopanel 7, 8 can be completely regenerated. In addition, leakage can be accurately checked for.

Furthermore, when the regeneration has completed, since the inside of the pump casing 2 is held at a high vacuum of $1/10^3$ Pa or less, it is possible to reduce time required for cooling the second stage cryopanel 8 to a temperature of 20 K. and to reduce time for evacuation in the following discharging. When the quick cooling is effected by bringing the rotational speed of the expander motor to 90 rpm, it is possible to reduce time required for cooling to a temperature of 20 K. about 20% as compared with the conventional practice. In FIG. 7, the processing procedure up to time $t_3$ is about the same as in an example of the known processing procedure shown in FIG. 8.

The explanation has been made about partial regeneration where argon Ar regenerative process is performed. Also, it is apparent that the similar effect can be expected in complete regeneration where regeneration also covers water adsorbed on the first stage cryopanel.

The following fact was experimentally confirmed: When an internal pressure of the pump casing 2 is reduced to $1/10^3$ Pa, as described above, hydrogen pumping capacity in the subsequent discharge step remains unchanged. However, when an internal pressure of the pump casing 2 is reduced only to 1–1/10 Pa hydrogen pumping capacity in the subsequent discharge step lowers by 5–10%. Even when a pressure of $1/10^3$ Pa is not reached, it is apparent that similar results can be obtained at pressures at which the molecular flow zone of an object substance is established. However, to effect regeneration, it is desirable to reduce the pressure to $1/10^3$ Pa.

Furthermore, according to the present embodiment, the expander motor 9 (consisting of a synchronous motor) may be run at a maximum speed (90 rpm) for cooling down, thereby bringing the first stage 6-1 of the refrigerator 6 to a temperature of 80 K. and the second stage 6-2 to 20 K. Thus, time required for establishing the state of pumping can be reduced. According to an experiment, it took 80 minutes to cool the second stage 6-2 of the refrigerator 6 from a temperature of 300 K. to 20 K. at a normal speed (72 rpm, powered at 60 Hz), while the time was reduced to 65 minutes at the maximum speed (90 rpm).

The time may be further reduced by setting a maximum speed of the expander motor to more than 90 rpm. This, however, would cause a severe wear of seals of an expander with a resultant reduction of its service life, and hence it is desirable to employ a maximum speed of 90 rpm for the expander motor.

In the above-mentioned embodiment, the first stage cryopanel 7 has a structure that metal plates shaped like a lamp shade are arranged horizontally in an overlapping manner, and the second stage cryopanel 8 has a structure that metal plates shaped like a lamp shade are arranged vertically in an overlapping manner. Needless to say, the structure of the first and second stage cryopanels 7, 8 is not limited to this. Also, in the above-mentioned embodiment, the controller 18 supplies power to the heaters 15, 16, 17. However, a power source may be provided separately, and the controller 18 may issue only control signals to control power supplied therefrom. In addition, the controller 18 supplies power to the turbo-molecular pump 11 and roughing vacuum pump 12. Again, a driving power source may be provided separately, and the controller 18 may issue only control signals to control power supplied therefrom.

As has been stated above, according to the regenerative apparatus and method of the present invention, on completion of releasing gases from a first stage cryopanel surface and/or second stage cryopanel surface, an internal pressure of a cryopump is quickly reduced to $1/10^3$ Pa or less with the cryopanel surface maintained at the same temperature as in releasing gases, and then the second stage cryopanel surface is quickly cooled to a temperature of 20 K. Thus, there can be provided a regeneration method and apparatus for a cryopump capable of regenerating cryopanels completely and of reducing a regeneration time required for resuming running a cryopump.

Figure 9:
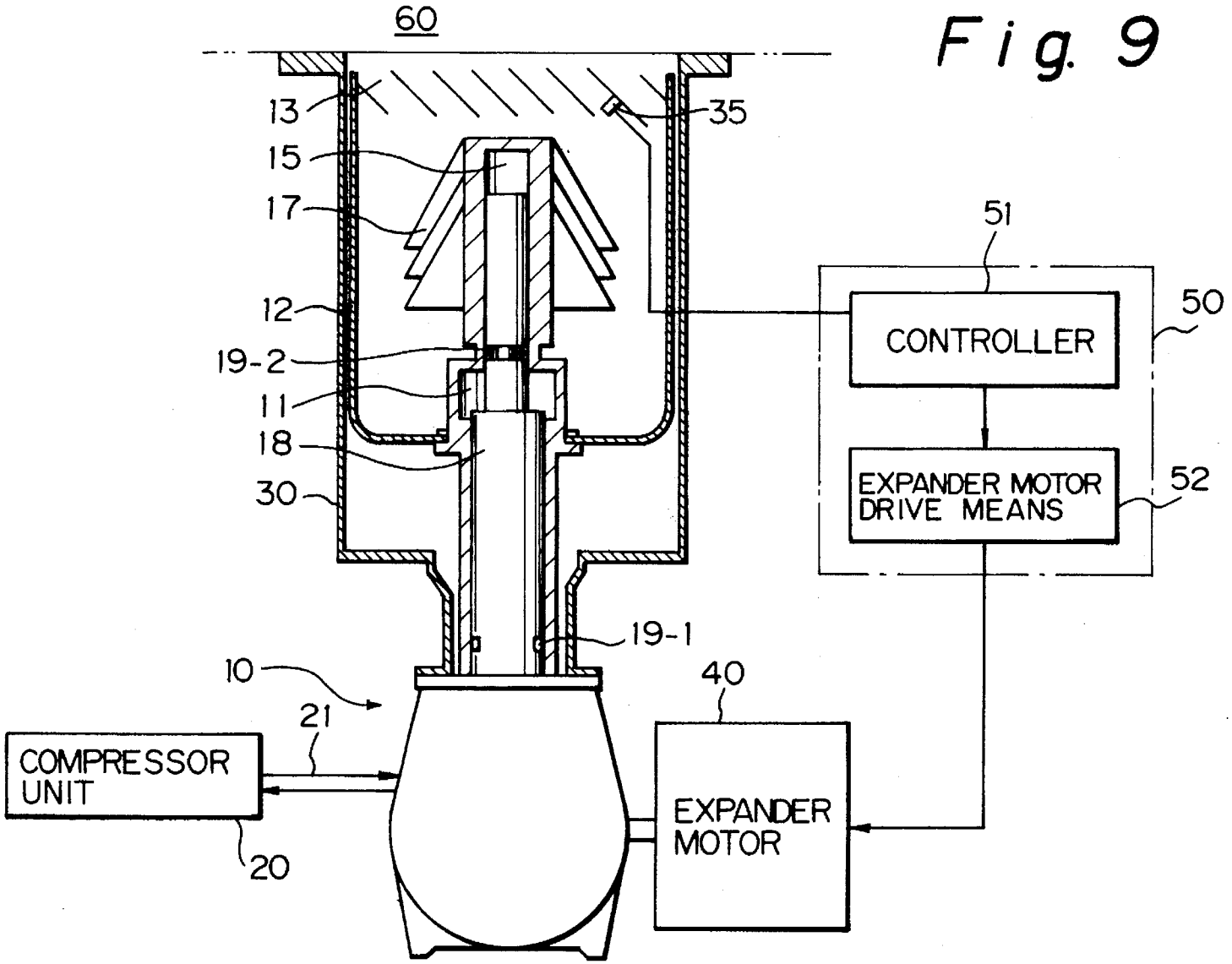
FIG. 9 is a schematic view illustrative of the construction of a cryopump according to another embodiment of the present invention.

Temperature Control:

FIG. 9 is a schematic view illustrative of the construction of a cryopump according to the further embodiment of the present invention. As illustrated in FIG. 9, the cryopump is constructed in such a manner that a compressor unit 20 is connected to a refrigerator 10 via piping 21. The refrigerator 10 comprises an expander 18 therein which is moved up and down by an expander motor (synchronous motor) 40. The vertical movement of the expander 18 causes an working gas (helium He gas) at room temperature and high pressure fed from the compressor unit 20 to be adiabatically expanded in a first stage expanding portion 11 and a second stage expanding portion 15, thereby generating cryogenic temperatures. 19-1 and 19-2 indicate first and second sealing portions of the expander 18, respectively.

A first stage cryopanel 13 is attached to the top end of the first stage expanding portion 11 via a heat transfer element 12. A second stage cryopanel 17 is directly attached to the second stage expanding portion 15.

The first and second stage expanding portions 11 and 15 of the refrigerator 10 are surrounded by a casing 30 whose top end is connected to a vacuum chamber 60 through a gate valve not shown.

Explanation will now be made of the operation of the cryopump constructed as described above. An working gas at high pressure is supplied to the refrigerator 10 from the compressor unit 20 and is further fed to the first and second stage expanding portions 11 and 15 through a valve (not shown) which opens and closes, being operationally linked with the vertical movement of the expander 18. The gas is thus adiabatically expanded in the first and second stage expanding portions 11 and 15, thereby generating cryogenic temperatures. The expanded gas passes through a passage (not shown) and is fed to an expander motor 40 to cool it and to be fed back to the compressor unit 20. After the gas has been compressed in the compressor unit 20, it is subjected to treatment, such as oil separation and the like, and is fed back to the refrigerator 10 as an working gas at high pressure. The cryogenic temperatures generated in the first and second stage expanding portions 11 and 15 allow the first and second cryopanels 13 and 17 to be cooled.

The cryopanels 13 and 17 are thus cooled as described above so that water within the vacuum chamber 60 is primarily condensed on the surface of the first stage cryopanel 13 while an argon (Ar) gas and a nitrogen ($N_2$) gas are condensed on the front surface of the second stage cryopanel 17. Further, a hydrogen ($H_2$) gas is cryogenically sucked onto an activated charcoal layer or the like formed on the reverse surface of the second stage cryopanel 17. Such a condensing and adsorbing operation allows the gas in the vacuum chamber 60 to be discharged.

A temperature sensor 35 detects the surface temperature of the first stage cryopanel 13, the detected output being input into control means 51 of a control part 50. The control means 51 allows the operation of the expander motor 40 to be temporarily suspended or to be rotated in a reverse direction via expander motor drive means 52, thereby keeping the first and second stage cryopanels 13 and 17 at constant temperatures.

Figure 10:
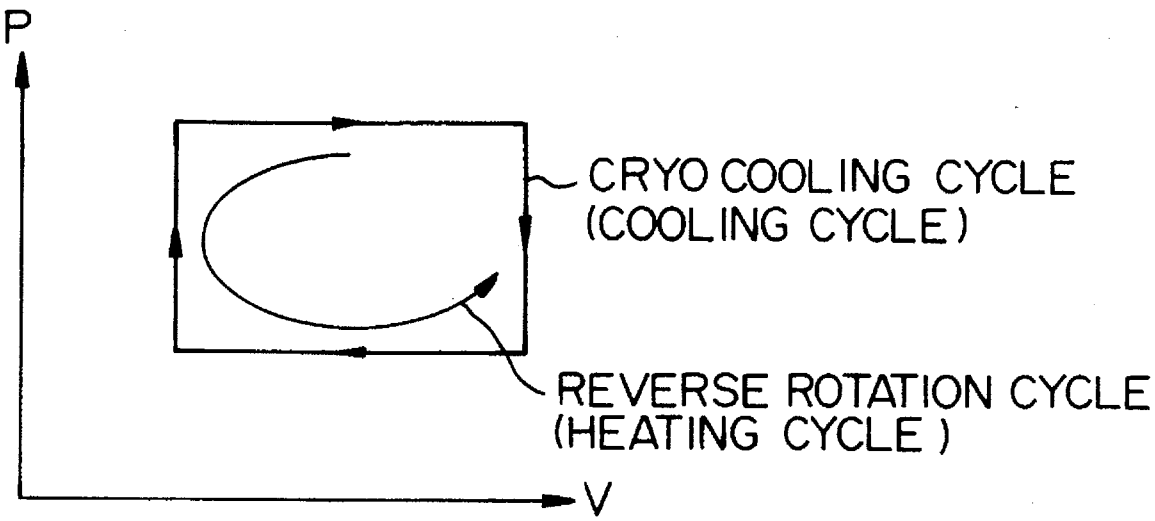
FIG. 10 show the theoretical refrigerating cycle (P-V characteristics) of the cryopump.

The theoretical refrigerating cycle of the cryopump is based on the relationship between P (pressure) and V (volume) of an working gas (for example, helium He gas), as shown in FIG. 10. An working gas at room temperature and high pressure is supplied to the refrigerator 10, and the expander 18 is lowered to allow the gas to be expanded adiabatically in the first and second stage expanding portions 11 and 15, thereby generating cryogenic temperatures. When the expander 18 is temporarily suspended, i.e., when the rotation of the expander motor 40 is temporarily suspended, adiabatic expansion of the gas does not occur, thus preventing the generation of cryogenic temperatures, resulting in an increase in the temperatures of the first and second stage cryopanels 13 and 17.

According to the above-described theory, based on a detected output from the temperature sensor 35, the control means 51 determines how long the expander motor 40 will be temporarily suspended via the expander motor drive means 52, thereby maintaining the first and second stage cryopanels 13 and 17 at predetermined temperatures.

In contrast to the above-described refrigerating cycle shown in FIG. 10, a heating cycle can be accomplished by reversing the refrigerating cycle. That is, an working gas at room temperature and low pressure is supplied to the cryopump so as to be adiabatically compressed, thereby generating heat. This heating operation can be realized by supplying an working gas at room temperature and low pressure from the compressor unit 20 and by reversing the expander motor 40.

Thus, as described above, based on a detected output from the temperature sensor 35, the control means 51 permits the expander motor 40 to be reversely rotated and also controls the speed thereof via the expander motor drive means 52. It is thus possible to heat and maintain the first and second stage cryopanels 13 and 17 at constant temperatures.

The cryopanels 13 and 17 are thus heated by reversing the rotation of the expander motor 40, thus effectively transforming the condensed or adsorbed substances on the first and second stage cryopanels 13 and 17 to be in the complete form of a gas and then discharging it to the exterior of the system. In order to realize such a transformation and discharge, it is first necessary to set the heating temperatures of the first and second stage cryopanels, and then to reversely rotate the expander motor 40 and control the speed thereof so as to reach the set temperatures.

The heating temperatures of the first and second stage cryopanels 13 and 17 during the regenerating operation depend on the substance to be discharged, as shown in Table 1 above.

Based on a detected output from the temperature sensor 35, the control means 51 permits the expander motor 40 to be reversely rotated and also controls the speed thereof via the expander motor drive means 52. Upon effecting control, the first and second stage cryopanels 13 and 17 can respectively reach the set temperatures described in Table 1, thus performing the regenerating operation.

Figure 11A:
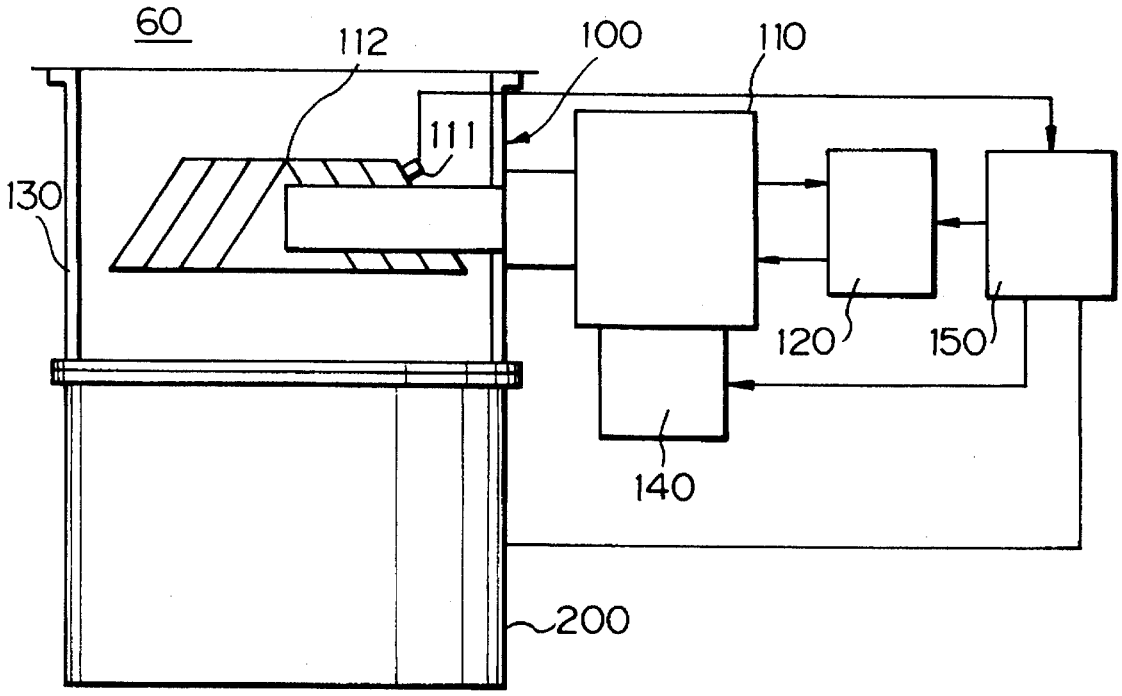
FIG. 11(*a*) is a sectional view illustrative of the schematic construction of a cryoturbo using a cold trap according to the present invention.
Figure 11B:
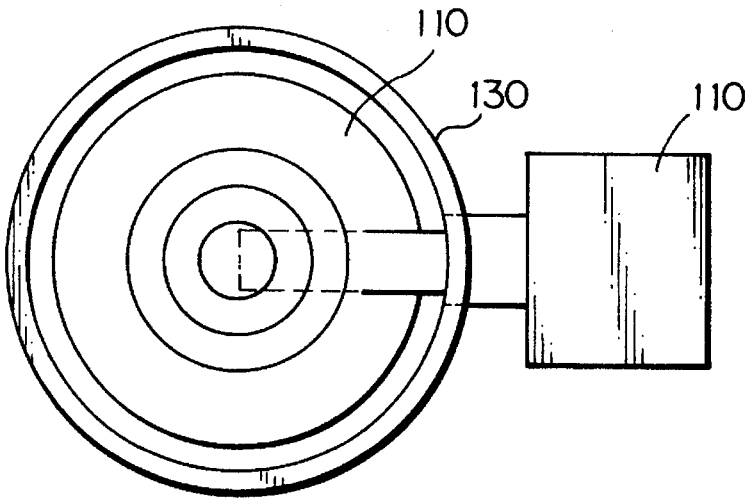

FIG. 11 illustrates the construction of, what is called, "a cryoturbo" formed by integrating a cold trap and a turbo molecular pump. FIG. 11(*a*) is a cross sectional view of the cryoturbo, while FIG. 11(*b*) is a top view thereof. A cold trap generally denoted by 100 comprises a single stage expanding portion (not shown) (equivalent to the first stage expanding portion 11 illustrated in FIG. 9) and a single stage bevelled cryopanel 112, these components being accommodated in a casing 130. A vacuum chamber 60 used in a vacuum process is connected to the top end of the casing 130.

A turbo molecular pump 200 is connected to the bottom end of the casing 130. For producing a vacuum in the vacuum chamber 60 by the molecular pump 200, an expander motor 140 of the cold trap 100 is actuated so as to allow water vapor in the vacuum chamber 60 to be selectively condensed on the cryopanel 112. During this operation, as in the cryopump shown in FIG. 9, an working gas at room temperature and high pressure is supplied from the compressor unit 120 and is expanded adiabatically to generate cryogenic temperatures, which enables a gas in the vacuum chamber 60 to be pumped.

For the regeneration of a gas in the cold trap 100, a control part 150 maintains the surface of the cryopanel 112 at a set temperature so as to discharge the condensed water vapor on the surface of the cryopanel 112. This can be carried out by the following process. Based on an output from a temperature sensor 111 for detecting the surface temperature of the cryopanel 112, the control part 150 determines how long the expander motor 140 is temporarily suspended or reversely rotated, and upon this determination, it permits the motor 140 to be suspended or to be reversely rotated. This operation allows the cold trap 100 to be reused as heating means for heating the cryopanel 112 at a predetermined set temperature. As described above, such heating can be implemented by controlling the number of reverse rotations of the expander motor 140.

For performing the heating operation by the reverse rotation of the expander motor 140, the control part 150 switches an working gas supplied from the compressor unit 120 to a gas at room temperature and low pressure which is then compressed adiabatically by the reciprocation of the expander, thereby generating heat and heating the cryopanel 112.

As stated above, the temperature sensor is disposed to detect the surface temperature of the cryopanel of the cryopump or that of the cold trap. Also, the control means is provided to allow the expander to be temporarily suspended for a certain period of time or to be reversely rotated based on a detection signal from the temperature sensor. It is thus possible to maintain the surface temperature of the first and/or the second stage cryopanel(s) of the cryopump or that of the cold trap within a predetermined range(s).

Therefore, a temperature control method according to the subject invention offers the following advantages.

(1) It is possible to maintain the surface(s) of the first stage and/or the second stage cryopanel(s) or that of the cold trap within a predetermined range(s) without requiring a heater.

(2) The temperature can be controlled to prevent any local variation in the temperature, thus obtaining a stable and constant discharge performance.

(3) The temperature can be controlled to prevent any local variation in the temperature, thus enabling a sufficient regeneration.

(4) The cryopump or the cold trap can be simply and safely constructed since a heater is not required.

(5) The cryopump or the cold trap is free from gas discharge, which would otherwise occur from a heater, thereby obtaining a high degree of vacuum in the vacuum chamber.

Although in the foregoing description, various features of this invention are separately explained, it will be apparent that these features may be independently or jointly used depending on need.

What is claimed is:

1. A cryopump comprising:

a compressor unit for inhaling a low pressure working gas and discharging a high pressure and ordinary temperature working gas;

an expanding portion driven by an expander motor for adiabatically expanding said high pressure and ordinary temperature working gas discharged from said compressor unit to generate a cryogenic temperature, said compressor unit and said expanding portion being connected to each other to form a closed circuit; and a cryopanel cooled by the cryogenic temperature generated by said expanding portion, characterized in that said cryopump further comprises:

detecting means for detecting an operation parameter at an elapsed operation time in a current operation cycle of said cryopump;

storing means for storing a value of another operation parameter at a corresponding elapsed operation time in a past operation cycle of said cryopump as a management parameter;

arithmetic controlling means for calculating a succeeding rotational speed of said expander motor based on said current operational parameter and said management parameter stored in said storing means and outputting the same as a driving instruction signal, with which the succeeding rotational speed of said expander motor is controlled so as to maintain a temperature of said cryopanel or a pressure in a vacuum chamber to which said cryopump is attached at a predetermined value by using a current rotational speed of said expander motor and a rotational speed at said corresponding elapsed operation time in the past operation cycle of the cryopump stored in said storing means as the management parameter; and expander motor driving means for driving said expander motor according to the driving instruction signal output from said arithmetic controlling means.

2. A cryopump according to claim 1, wherein said operation parameter comprises a current temperature of said cryopanel and a current rotational speed of said expander motor, said another operation parameter comprises a rotational speed of said expander motor at a corresponding elapsed operation time in said past operation cycle, and said arithmetic controlling means controls the speed of said expander motor so as to maintain said temperature of said cryopanel at said predetermined value.

3. A cryopump according to claim 2, wherein said past operation cycle is a last or second to last operation cycle of said cryopump.

4. A cryopump according to claim 1, wherein said operation parameter comprises a current pressure in said vacuum pump and a current rotational speed of said expander motor, said another operation parameter comprises a rotational speed of said expander motor at a corresponding elapsed operation time in said past operation cycle, and said arithmetic controlling means controls the speed of said expander motor so as to maintain said pressure in said vacuum chamber at said predetermined value.

5. A cryopump according to claim 4, wherein said past operation cycle is a last or second to last operation cycle of said cryopump.

6. A cryopump according to claim 1, wherein said past operation cycle is a last or second to last operation cycle of said cryopump.

7. A cryopump comprising:

a compressor unit for inhaling a low pressure working gas and discharging a high pressure and ordinary temperature working gas;

an expanding portion driven by an expander motor for adiabatically expanding said high pressure and ordinary temperature working gas discharged from said compressor unit to generate a cryogenic temperature, said compressor unit and said expanding portion being connected to each other to form a closed circuit; and a cryopanel cooled by the cryogenic temperature generated by said expanding portion, characterized in that said cryopump further comprises:

detecting means for detecting an operation parameter at an elapsed operation time in a current operation cycle of said cryopump;

storing means for storing a value of a diagnosis parameter for judging a time for maintenance or regeneration of said cryopump;

arithmetic controlling means for judging whether said cryopump is now in the time for maintenance or regeneration by comparing the current operation parameter detected by said detecting means with the value of the diagnosis parameter stored in said storing means and outputting an alarm signal; and controlling means for displaying that the cryopump is now in the time for maintenance or regeneration based on the alarm signal output from said arithmetic controlling means.

8. A cryopump according to claim 7, wherein said operation parameter comprises a current rotational speed of said expander motor, said diagnosis parameter comprises an upper limit of rotational speed of said expander motor or little lower than the same, and said arithmetic controlling means judges that said cryopump is now in the time for regeneration when said current rotational speed exceeds said upper limit of rotational speed of said expander motor or little lower than the same.

9. A cryopump according to claim 7, wherein said operation parameter comprises a current rotational speed of said expander motor, said diagnosis parameter comprises a target exchanging time and an upper limit of the rotational speed of said expander limit, and said arithmetic controlling means judges that said cryopump is now in the time for maintenance when said current rotational speed exceeds said upper limit of the rotational speed of said expander motor before said target exchanging time.

10. A cryopump according to claim 7, wherein said operation parameter comprises a value of current temperature, pressure, rotational speed or vibration frequency of said cryopump, said diagnosis parameter comprises a predetermined value of temperature, pressure, rotational speed or vibration frequency of said pump which respectively are higher than normal value thereof, and said arithmetic controlling means judges that said cryopump is now in the time for maintenance when said current temperature, pressure, rotational speed or vibration frequency of said cryopump exceeds said predetermined value of the same.

11. A cryopump comprising:

a compressor unit for inhaling a low pressure working gas and discharging a high pressure and ordinary temperature working gas;

an expanding portion driven by an expander motor for adiabatically expanding the high pressure and ordinary temperature working gas discharged from said compressor unit to generate a cryogenic temperature, said compressor unit and said expanding portion being connected to each other to form a closed circuit; and a cryopanel cooled by the cryogenic temperature generated by said expanding portion, characterized in that said cryopump further comprises:.

detecting means for detecting an operation parameter at an elapsed operation time in a current operation cycle of said cryopump;

storing means for storing a value of another operation parameter at a corresponding elapsed operation time in a past operation cycle of said cryopump as a management parameter and storing a value of a diagnosis parameter to judge a time for maintenance or regeneration of said cryopump;

arithmetic controlling means for calculating a succeeding rotational speed of said expander motor based on the current operational parameter and the management parameter stored in said storing means and outputting the same as a driving instruction signal, with which a succeeding rotational speed of said expander motor is controlled so as to maintain a temperature of the cryopanel or a pressure in a chamber to which the cryopump is attached at a predetermined value by using a current rotational speed of said expander motor and a preceding rotational speed at the corresponding elapsed operation time in the past operation cycle of said cryopump stored in said storing means as the management parameter, and for judging whether said cryopump is now in the maintenance time or the regeneration time by comparing the current operation parameter detected by said detecting means with the value of the diagnosis parameter stored in said storing means and outputting an alarm signal;

expander motor driving means for driving said expander motor according to the driving instruction signal output from said arithmetic controlling means; and controlling means for displaying that the cryopump is now in the maintenance time or the regeneration time based on the alarm signal output from said arithmetic controlling means.

12. A regenerative method for a cryopump which includes at least one of first and second stage cryopanel surfaces to at least one of condense and adsorb gases thereon during a pump operation and a cooling mechanism for cooling said cryopanel surfaces, said method comprising:

releasing gases from at least one of said first stage cryopanel surface and said second stage cryopanel surface by maintaining said at least one of said cryopanel surfaces at a fixed temperature, and quickly reducing, upon completion of said releasing step, and internal pressure of said cryopump to $1/10^3$ Pa (pascal) or less with said at least one of said cryopanel surfaces being maintained at said fixed temperature, and then quickly cooling the second stage cryopanel surface to a temperature of 20 K. or lower.

13. A regenerative apparatus for a cryopump which includes at least one of first and second stage cryopanel surfaces to at least one of condense and absorb gases thereon during a pump operation and a cooling mechanism for cooling said cryopanel surfaces, said regenerative apparatus comprising:

heating means for heating at least one of said first stage cryopanel surface and said second stage cryopanel surface, a temperature sensor for detecting a temperature of said cryopanel surfaces, pressure detecting means for detecting an internal pressure of said cryopump, control means for generating a control signal in response to an output from said temperature sensor and an output from said pressure detecting means, and pressure reducing means for reducing an internal pressure of said cryopump, wherein upon completion by said cryopump of releasing gases from at least one of said first stage cryopanel surface and said second stage cryopanel surface by maintaining said at least one of said cryopanel surfaces at a fixed temperature, said control means causes said pressure reducing means to quickly reduce an internal pressure of said cryopump to $1/10^3$ Pa or less while controlling said heating means so as to maintain said at least one of said cryopanel surface at said fixed temperature, and then causes said cooling means to quickly cool said second stage cryopanel surface to a temperature of 20 K. or lower.

14. A regenerative apparatus for a cryopump according to claim 13, wherein said pressure reducing means comprises a vacuum pump including a turbo-molecular pump.

15. A regenerative apparatus for a cryopump according to claim 13, wherein said cooling means performs quick cooling by increasing a rotational speed of an expander motor of a refrigerator of said cryopump.

16. A regenerative apparatus for a cryopump according to claim 15, wherein a maximum rotational speed of said expander motor of a refrigerator is 80–120 rpm.

17. A cryopump comprising:

at least one of first said second stage cryopanels having respective surfaces onto which a gas is at least one of condensed and absorbed during a pump operation, a compressor unit, an expander for adiabatically expanding said compressor unit, an expander motor for driving said expander, cooling means for cooling said surfaces of at least one of said first and said second stage cryopanels, said cooling means allowing a working gas at room temperature and high pressure supplied from said compressor unit to be adiabatically expanded by said expander driven by said expander motor so as to generate cryogenic temperature, a temperature sensor for detecting the temperature of the surfaces of said at least one of first stage and second stage cryopanels; and control means for causing said expander to be one of operationally suspended for a certain period of time or rotated in a reverse direction, based on a detection signal from said temperature sensor, so as to control the temperature of the surfaces of said at least one of said first and second stage cryopanels to be within respective predetermined ranges.

18. A cold trap comprising:

a surface of a first stage cryopanel onto which a gas is condensed, a compressor unit, an expander for adiabatically expanding said compressor unit, an expander motor for driving said expander, cooling means for cooling the surface of said cryopanel, said cooling means allowing a working gas at room temperature and high pressure supplied from said compressor unit to be adiabatically expanded by said expander driven by said expander motor so as to generate cryogenic temperature, a temperature sensor for detecting the temperature of the surface of said cryopanel, and control means for causing said expander to be one of operationally suspended for a certain period of time or rotated in a reverse direction, based on a detection signal from said temperature sensor, so as to control the temperature of the surface of said cryopanel to be within a predetermined range.

* * * * *